US012653282B2

(12) United States Patent
Li

(10) Patent No.: US 12,653,282 B2
(45) Date of Patent: Jun. 16, 2026

(54) CANTILEVER UMBRELLA WITH A DUO-ARC-IN-SLIDING-SLEEVE CONFIGURATION

(71) Applicant: Linhai Taiji Crafts Co., Ltd., Linhai City (CN)

(72) Inventor: Chuan Li, Taizhou (CN)

( * ) Notice: Subject to any disclaimer, the term of this patent is extended or adjusted under 35 U.S.C. 154(b) by 0 days.

(21) Appl. No.: 19/245,331

(22) Filed: Jun. 22, 2025

(65) Prior Publication Data

US 2026/0101977 A1 Apr. 16, 2026

(30) Foreign Application Priority Data

Oct. 12, 2024 (CN) ..... 202422465429.X
Oct. 12, 2024 (CN) ..... 202422465434.0

(51) Int. Cl.
*A45B 23/00* (2006.01)
*A45B 25/14* (2006.01)
*E04H 12/22* (2006.01)

(52) U.S. Cl.
CPC ..... *A45B 23/00* (2013.01); *A45B 25/14* (2013.01); *E04H 12/2238* (2013.01); *E04H 12/2284* (2013.01); *A45B 2023/0012* (2013.01); *A45B 2023/0037* (2013.01); *A45B 2023/0062* (2013.01); *A45B 2200/1081* (2013.01)

(58) Field of Classification Search
CPC .... A45B 2023/0037; A45B 2023/0062; A45B 2023/0075
See application file for complete search history.

(56) References Cited

U.S. PATENT DOCUMENTS

D398,443 S * 9/1998 Bolle ..... D3/5
6,511,033 B2 * 1/2003 Li ..... A45B 23/00 248/519
6,953,043 B2 * 10/2005 Yu ..... A45B 23/00 135/21
8,360,080 B2 * 1/2013 Liu ..... A45B 17/00 135/20.1
8,807,513 B2 * 8/2014 Volin ..... A45B 23/00 248/521

(Continued)

FOREIGN PATENT DOCUMENTS

CN 201019107 2/2008
CN 202858065 4/2013

(Continued)

*Primary Examiner* — Noah Chandler Hawk
(74) *Attorney, Agent, or Firm* — Milstein Zhang & Wu LLC; Duan Wu, Esq.

(57) ABSTRACT

This invention discloses a cantilever umbrella with duo-arc tubes in a sliding-sleeve configuration, which includes: a base support for the arched tubes, a lower arched tube, an upper arched tube, a main canopy frame and a handle assembly. The upper arched tube is slidably connected with the lower arched tube through the handle assembly; the umbrella's main canopy frame is installed at the distal end of the upper arched tube through a canopy base junction; a mounting channel cooperating with the upper arched tube is provided on the inner surface of said lower arched tube—said mounting channel, once mated with the upper arched tube, leads to a semi-covered structure over the upper arched tube; and a winding wheel is provided to control the open and close of the main canopy frame.

21 Claims, 16 Drawing Sheets

(56) References Cited

U.S. PATENT DOCUMENTS

| | | | | |
|---|---|---|---|---|
| 12,324,492 | B1 * | 6/2025 | He | A45B 23/00 |
| 2002/0083969 | A1 * | 7/2002 | Tung | A45B 23/00<br>135/96 |
| 2008/0236640 | A1 * | 10/2008 | Huali | A45B 25/14<br>135/20.3 |
| 2010/0101614 | A1 * | 4/2010 | Wang | A45B 19/04<br>135/20.1 |
| 2012/0024330 | A1 * | 2/2012 | Ma | B62B 5/0083<br>280/30 |
| 2017/0114563 | A1 * | 4/2017 | Ye | A45B 23/00 |
| 2024/0335414 | A1 | 10/2024 | Ma | |

FOREIGN PATENT DOCUMENTS

| | | |
|---|---|---|
| CN | 218457540 | 2/2023 |
| CN | 221012246 | 5/2024 |
| CN | 221241903 | 7/2024 |

* cited by examiner

CANTILEVER UMBRELLA WITH A DUO-ARC-IN-SLIDING-SLEEVE CONFIGURATION

CROSS-REFERENCE TO RELATED APPLICATIONS

This application claims priority to and the benefit of co-pending Chinese Patent Application Serial Nos. CN 202422465429.X and CN 202422465434.0, both filed Oct. 12, 2024, which applications are incorporated herein by reference in their entirety.

TECHNICAL FIELD

The present invention relates to the technical field of outdoor umbrellas, in particular to an offset, cantilever umbrella.

BACKGROUND

Outdoor umbrellas, also referred to as sunshade umbrellas, can be divided into side-pole umbrellas, Roman umbrellas, banana umbrellas and the like according to the shape, all belonging to offset or cantilever umbrellas where the main support column/pole is located on the side rather than the center of the canopy. The bent-arm cantilever umbrella is rather unique among outdoor sunshade umbrellas in terms of style; with a healthy market share, and a well-received esthetics, it is popular with many consumers.

In the prior art, a bent arm cantilever umbrella is mainly composed of an upper arched or curved tube, a lower arched or curved tube, an umbrella canopy and a support base, where the upper arched tube and the lower arched tube are mainly divided into two types according to the way they are put together. The first type is a plug-in telescopic structure, and when the upper arched tube stretches outwards to an extremity, the umbrella frame is driven open through rotation of a wire-winding wheel. The second type is a side-by-side extendible structure, where the upper arched tube and the lower arched tube are arranged side by side, and are connected through a handle assembly that drives the upper arched tube to either extend outwards or collapse inwards.

For example, Chinese Patent Publication No. CN 221241903-U discloses an arched-column outdoor umbrella with a press-lever mechanism for opening and closing of the umbrella, where the umbrella column is an arched column arranged on one side of the umbrella's canopy frame, and where the canopy frame includes a cross-lever assembly hinged between an upper umbrella tray and lower umbrella tray. A press-lever mechanism is provided on said arched column to control the open and close of the canopy frame; the press-lever mechanism includes: a sliding sleeve arranged on the upper portion of the arched column and movable up and down along the same arched column, a handle assembly hinged to the lower portion of the arched column, and a pull lever arranged between the sliding sleeve and the handle assembly. The cross-lever assembly includes a first cross-lever assembly and a second cross-lever assembly connected through a hinge, where one end of the first cross-lever assembly is hinged to the upper umbrella tray, and the other end hinged to the sliding sleeve, and where one end of the second cross-lever assembly is hinged to the lower umbrella tray, and the other end hinged to the top seat arranged at the top of the umbrella column. The middle of the handle assembly is connected to the umbrella column through a hinge.

In addition, in Chinese Patent Publication No. CN 201019107-Y, a bent-arm umbrella is also disclosed. The umbrella mainly consists of a standing pipe, an upper arched tube, a lower arched tube, and an umbrella canopy frame: the bottom of the lower arched tube is connected to the top of the standing pipe; the radian of the upper arched tube is the same as that of the lower arched tube so that the two can slide relative to each other; a handheld telescopic positioning mechanism is arranged at the joint of the upper arched tube and the lower arched tube. The top of the standing pipe and the bottom of the lower arched tube are connected through a horizontal-rotary type structure; and the top of the upper arched tube and the upper umbrella disk of the canopy frame are connected through a pitching-rotary type structure.

With regard to the above patent documents, in the first patent disclosure: after the umbrella frame is unfolded, an issue arises as the orientation angle of the canopy frame is difficult to adjust in order to satisfy the requirements from different customers. In the second patent disclosure, due to the fact that the upper arched tube and the lower arched tube are arranged side by side, the space thereby occupied by the tubes during transportation is relatively large, resulting in increased costs during transportation.

Moreover, sunshade umbrellas often come with a rotatable base, such as those disclosed in Chinese Patent Publication No. CN214904320-U, where an umbrella's rotatable base assembly is disclosed as including a rotatable base, a sleeve welding piece, and a foot pedal assembly. The sleeve welding piece comprises a sleeve tube and a bottom plate, where the sleeve tube is vertically inserted into the mid-section of the bottom plate's upper surface before being welded and thereby affixed to the bottom plate, the rotatable base is fitted over said sleeve tube and above the bottom plate. The umbrella column's lower end is fitted over said sleeve tube and insertingly connected with said rotatable base. The pedal assembly is comprised of a foot pedal and a pedal shaft; the foot pedal is assembled on the upper side of the rotatable base through a reversible rotation mechanism; the pedal shaft is vertically arranged at the lower end of the inner side of the foot pedal. The pedal shaft penetrates through the rotatable base to be pin-matched through a positioning aperture in the bottom plate, and the pedal shaft is locked or unlocked from the bottom plate through operation of the pedal, such that clamping and rotation of the rotatable base can be effectuated.

When the above rotatable base is being operated, if the umbrella canopy needs to be rotated, an operator must first stamp on the foot pedal by foot to disengage the pin shaft, therefore the rotatable base, from the positioning aperture; then hold the column by hand to rotate the vertical column of the umbrella above; and finally the operator can slowly rotate the canopy within a horizontal plane parallel to the ground. When the operator is finishing up with the foot stamping, the operator needs to pay attention to parts being stamped on by foot and the hand-rotating situation of the vertical column at the same time, i.e., the operator needs to multi-task. If the canopy of the outdoor umbrella is relatively large, it may be difficult for the operator to ensure the stability of the vertical column during rotation, therefore, shaking of the umbrella is prone to occurring—this makes the rotating operation by an operator of the umbrella column relatively inconvenient, compromising the operational experience.

SUMMARY OF THE INVENTION

In order to overcome disadvantages in the prior art, the present invention hereby provides a duo-arc, sliding sleeve, cantilever umbrella. Specifically, the present invention aims to solve the technical challenge where minimizing storage space for both arched tubes and ease of adjusting umbrella canopy are difficult to satisfy at the same time. The invention also aims to solve existing rotatable umbrella base's problem of being inconvenient to operate.

According to the present invention, these technical problems can be solved by adopting the following technical schemes:

A cantilever umbrella is disclosed with a spine of duo-arc tubes in a sliding-sleeve configuration, and includes: a lower arched tube, an upper arched tube, a main canopy frame and a handle assembly. Said upper arched tube is slidably connected with the lower arched tube through the handle assembly; said main canopy frame is installed at the distal end of the upper arched tube through a canopy base junction. These are further characterized as: a mounting channel cooperating or receptively mating with the upper arched tube is provided on the inner surface of said lower arched tube-said mounting channel enables the formation of a semi-covered structure for the upper arched tube to nestle therein as the channel is designed to receive and at least partly house the upper arched tube as it slides down or collapses into the channel (or vice versa where the mounting channel is provided in the upper arched tube to receive the lower arched tube); said handle assembly includes a handle shell main body, a winding wheel set, and a locking mechanism assembled in cooperation with the handle shell main body; said handle shell main body is slidably connected to said lower arched tube, said locking mechanism provided to effect locking positions between said handle shell main body and said lower arched tube; and said winding wheel set is provided to control the open and close of the main canopy frame.

The structures of the handle shell main body include a first shell body and a second shell body. The first shell and the second shell bodies are combined and sleeved over the lower arched tube; a winding wheel mounting cavity and a lock mounting cavity are provided in said handle shell main body. The winding wheel set is arranged in the winding wheel mounting cavity; and a locking mechanism is arranged in the lock mounting cavity.

Said locking mechanism includes a control member and a locking assembly. The locking assembly is slidably connected to the handle shell main body and can move towards the side of the lower arched tube through a push of the control member. When the locking assembly abuts the lower arched tube, the position between the handle shell main body and the lower arched tube is locked.

The locking assembly includes a sliding block and a pressing block. The above-mentioned control member adopts a locking trigger; said pressing block is affixed to the sliding block, and the locking trigger is rotatably connected to a mounting seat. When the locking trigger rotates clockwise, it will push the sliding block towards the side of the lower arched tube; when the locking trigger rotates counterclockwise, its end moves away from the sliding block, and the sliding block will naturally slide down under the influence of gravity, moving the pressing block away from the lower arched tube, thereby unlocking the lower arched tube from the handle shell body.

Said locking trigger can be divided into a locking part on the inside and a holding part on the outside: a user can hold the holding part of the locking trigger; the locking part is divided into a protruding section at one end and an unlocking section off to the side of that same end. When the protruding section abuts against the sliding block, the relative positions between the handle shell main body and the lower arched tube are locked; and when the unlocking section abuts against the sliding block, the relative positions between the handle shell main body and the lower arched tube are unlocked.

The lower arched tube is preferably of a semi-elliptical-shaped structure, while the locking part is preferably of an oval-shaped structure.

Said winding wheel set includes a winding wheel, a crank axle and a first torsion spring, which are all sequentially arranged in series in a sleeving manner. Specifically, the crank axle is rotatably connected to the handle shell main body, and insertingly connected, on the outer end, to a crank handle; a rope is wound on the winding wheel, the distal end of the rope connected to the umbrella's main canopy frame.

The top of the umbrella's main canopy frame is rotatably connected to the umbrella's canopy base junction; a position-stopping edge that cooperates with the top of the main canopy frame is provided in the canopy base junction.

Pulleys are arranged on the edges of both sides of a clamping notch where the first and second (handle) shell bodies mate with the lower arched tube.

Over the above-described lower arched tube, an upper lining and a lower lining are arranged spaced from each other. A first clamping groove and a second clamping groove that match with the upper lining and the lower lining, respectively, are provided in the opposite side faces of the first and the second shell bodies: the upper lining and the lower lining are arranged to be inserted into the first clamping groove and the second clamping groove, respectively.

The inventive embodiment can further include a tube support to which the proximal end of an umbrella spine such as the described lower arched tube is affixed. The tube support, in an embodiment, includes: a mounting base, an inner vertical pipe, an outer vertical pipe and a locking structure. The inner vertical pipe is fixedly attached to the top of the mounting base. The outer vertical pipe sleeves over the outer surface of the inner vertical pipe and forms rotational cooperation with the inner vertical pipe. The locking structure is arranged between the inner vertical pipe and the outer vertical pipe.

The locking structure includes at least one fluted disk, at least one rotating sleeve piece and at least one locking assembly. A fluted disk is affixed to the top of the inner vertical pipe. A rotating sleeve piece is affixed to the outer vertical pipe and rotates in cooperation with the fluted disk. A locking assembly arranged on the outer vertical pipe will lock or unlock said pipe as parts of the assembly insert into or disengage from toothed grooves of the fluted disk.

The locking assembly, in an embodiment, includes a fixed sleeve seat and a wrench. The fixed sleeve seat is affixed to the outer vertical pipe. A first receding groove and a second receding groove which are in communication with each other are provided in the fixed sleeve seat and the outer vertical pipe, respectively; the wrench is rotatably connected to the fixed sleeve seat, and a locking piece is arranged at the inner end of the wrench. The locking piece passes through the first receding groove and the second receding groove, and extends into an inner cavity of the outer vertical pipe; a locking groove that mates with the grooved teeth of the fluted disk is provided in the outer end of the locking piece.

A mounting groove is provided in the rotating end of the wrench; a second torsion spring is embedded in the inner wall of the mounting groove; the inner end of the second torsion spring is affixed to the inner wall of the mounting groove, and the other, outer end of the second torsion spring abuts against the outer vertical face of the fixed sleeve seat.

A position-restricting aperture which vertically penetrates is provided in the rotating sleeve piece; the position-restricting aperture is of a stepped structure; a connective, restricting shaft is arranged in the restricting aperture. The bottom of the restricting shaft is fixedly connected to the inner vertical pipe and used for restricting the relative positions between the rotating sleeve piece and the fluted disk.

The mounting base, according to another principle of the invention, is provided with a counterweight seat and two elongated pieces installed therein. The counterweight seat, in an embodiment, includes at least two counterweight blocks; accommodating housing grooves are provided in the opposing side faces of the two counterweight blocks. When the two counterweight blocks are closed/folded together, a housing cavity is formed between the two counterweight blocks. The two elongated pieces are arranged in the housing cavity and are arranged in an intersecting fashion to form a cross structure. A positioning aperture that mates or otherwise cooperate with the outer vertical pipe is provided in the top of the housing cavity; and the bottom portions of both the inner vertical pipe and the outer vertical pipe extend into the housing cavity through the positioning aperture.

The two counterweight blocks are, in an embodiment, semicircular structures, and a disk-shaped structure is formed when the counterweight blocks are closed; and the outer vertical pipe is a tubular structure with a circular cross-section.

And the two counterweight blocks are, in another embodiment, square or rectangular structures; and the outer vertical pipe is of a special-shaped structure with a cross-section with two parallel opposite laterals and two arc-shaped side laterals.

Optionally, a vertical pipe cover sleeves around the bottom portion of the outer vertical pipe; and the bottom of the vertical pipe cover abuts against the top surface of the counterweight blocks.

An integrally formed mounting plate is optionally affixed to the bottom of the inner vertical pipe; the mounting plate is also affixed to the two elongated pieces through screws. A vertical-pipe-positioning sleeve is embedded inside and fixedly attached to the bottom portion of the inner cavity of the outer vertical pipe; and a second gasket bearing is arranged between the vertical pipe positioning sleeve and the mounting base.

Compared to the prior art, the present invention possesses advantages at least as follows: (1) the semi-covered structure designed between the lower arched tube and the upper arched tube of the present disclosure greatly reduces any storage space needed for both tubes; (2) meanwhile, by restricting the canopy frame's positions, when it is in an open state, in relation to the upper arched tube, we allow adjustment of the angle of the umbrella canopy frame while remaining unfolded, as the upper arched tube moves up and down along the umbrella column/pole; (3) locking and unlocking of rotational operation of the outer vertical pipe are now achieved through the tooth-groove engagement and disengagement between the wrench and the fluted disk and taking place between the inner vertical pipe and the outer vertical pipe. This makes it much easier for a user to drive the outer vertical pipe in order to rotate it and hence the canopy left or right relative to the inner vertical pipe or the rest of the column, because the user is no longer forced to use a foot-stepping motion to unlocking the outer vertical pipe; (4) further operational convenience is achieved by arranging a second torsion spring on the wrench, so that when a user removes the pressure applied to the wrench, the second torsion spring drives the wrench to automatically reset and lock with the fluted disk through groove-tooth coupling; (5) the present invention also provides a vertical pipe cover that, in a shape that matches the pipe, sleeves about the bottom portion of the outer vertical pipe, where the pipe cover abuts against the top face of the counterweight blocks to increase the supportive area for the bottom of the outer vertical pipe, thereby improving the stability for the vertical pipe when in rotation.

The characteristics of the invention can be more clearly understood with reference to the drawings of the present disclosure and the following detailed description of the preferred embodiments.

Figure 1A:
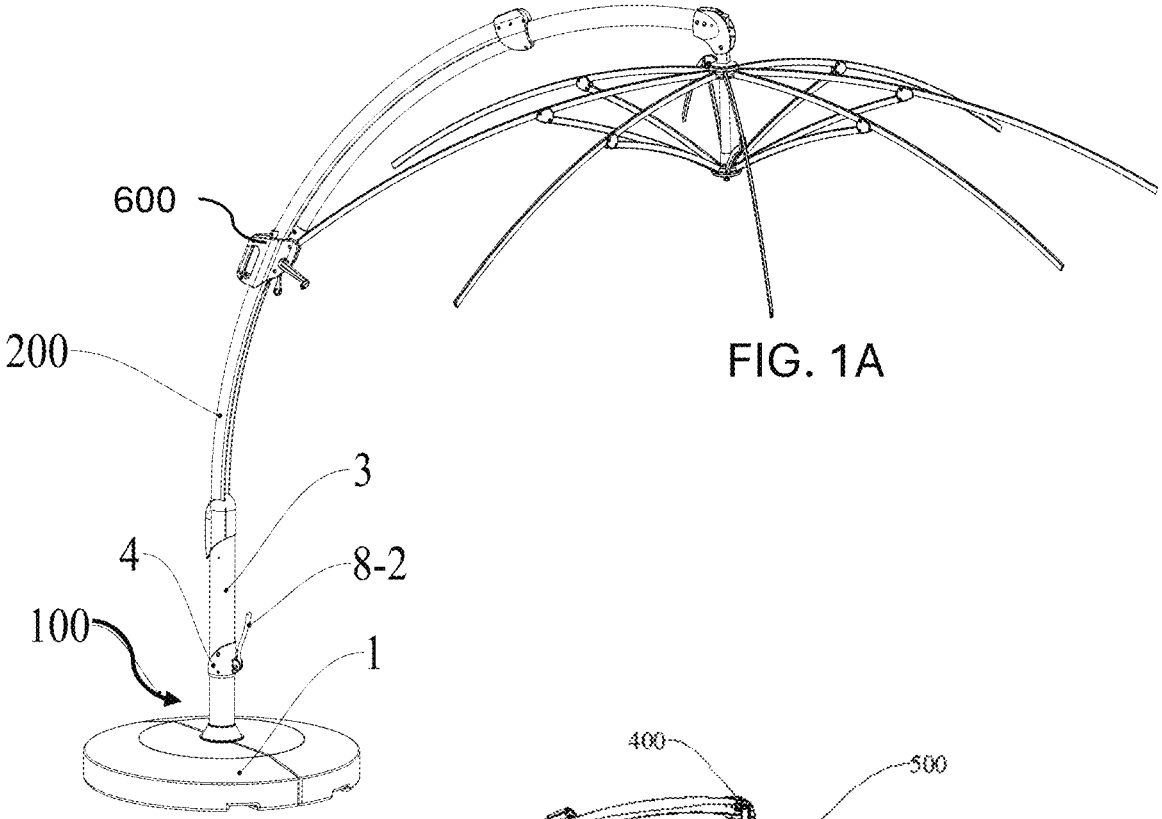
FIG. 1A is a prospective illustration of an overall structure of an embodiment of the present utility invention.

Reference numbers: 100: tube support; 200: lower arched tube; 300: upper arched tube; 400: canopy base junction; 410: stopping edge or edge stop; 500: main canopy frame; 600: handle assembly; 610: handle shell (main) body; 611: first shell body; 612: second shell body; 620: winding wheel set; 621: winding wheel; 622: crank axle; 623: first torsion spring; 630: locking mechanism; 631: mounting seat; 632: control member; 6321: protruding section; 6322: unlocking section; 633: sliding block; 634: pressing block; 1: mounting base; 1-1: counterweight seat; 1-2: elongated piece; 2: inner vertical pipe; 3: outer vertical pipe; 4: locking structure; 5: fluted disk; 6: first gasket bearing; 7: rotating sleeve piece; 8: locking assembly; 8-1: fixing sleeve seat; 8-2: wrench; 8-3: locking piece; 8-4: second torsion spring; 9: vertical-pipe-positioning sleeve; and 10: vertical pipe cover.

DETAILED DESCRIPTION OF THE EMBODIMENTS

In order to enable easy understanding of the technical means, the inventive characteristics, and the goals achieved and effects realized with respect to the present disclosure, the invention is further described in combination with specific illustrated examples below.

As used in the specification and claims, the singular form "a", "an", or "the" includes plural references unless the context clearly dictates otherwise. For example, the term "a screw" includes a plurality of screws including mixtures thereof. It is further noted that the claims may be drafted to exclude any optional element. As such, this statement is intended to serve as support for the recitation in the claims of such exclusive terminology as "solely," "only" and the like in connection with the recitation of claim elements, or use of a "negative" limitations, such as "wherein [a particular feature or element] is absent," or "except for [a particular feature or element]," or "wherein [a particular feature or element] is not present (included, etc.) . . . ".

In the description of the present invention, it is to be understood that the terms "one end", "other end", "outside", "upper", "inside", "horizontal", "coaxial", "center", "end", "length", "outer end", etc., indicate orientations or positional relationships based on the orientations or positional relationships shown in the drawings and are for convenience and simplification of the present disclosure, and do not indicate or imply that the device or element referred to must have a particular orientation, or be constructed and operated in a particular orientation. Therefore, such terms are not to be construed as limiting the present invention whatsoever.

When a dimensional measurement is given for a part herein, the value is, unless explicitly stated or clear from the context, meant to describe an average for a necessary portion of the part, i.e., an average for the portion of the part that is needed for the stated purpose. Any accessory or excessive portion is not meant to be included in the calculation of the value.

As used herein, the recitation of a numerical range for a variable is intended to convey that the invention may be practiced with the variable equal to any of the values within that range. Thus, for a variable which is inherently discrete, the variable can be equal to any integer value within the numerical range, including the endpoints of the range. Similarly, for a variable which is inherently continuous, the variable can be equal to any real value within the numerical range, including the endpoints of the range. As an example, and without limitation, a variable which is described as having values between 0 and 2 can take the values 0, 1 or 2 if the variable is inherently discrete, and can take the values 0.0, 0.1, 0.01, 0.001, or any other real values >0 and <2 if the variable is inherently continuous.

As used herein, "about" means within plus or minus 10%. For example, "about 1" means "0.9 to 1.1", "about 2%" means "1.8% to 2.2%", "about 2% to 3%" means "1.8% to 3.3%", and "about 3% to about 4%" means "2.7% to 4.4%."

Example 1

Figure 1B:
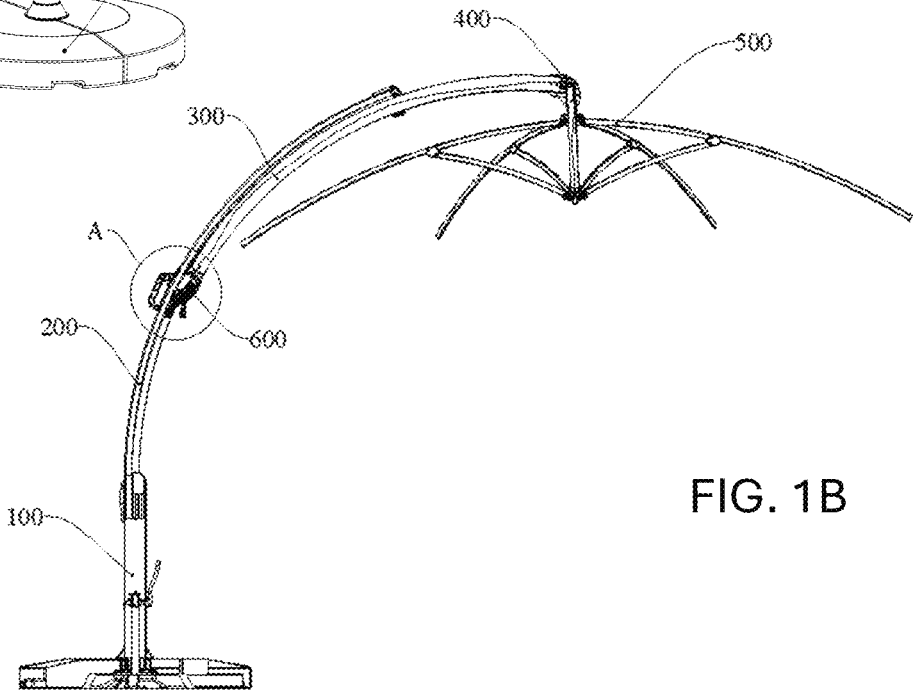
FIG. 1B is vertical cross-section view of the embodiment shown in FIG. 1A.
Figure 2:
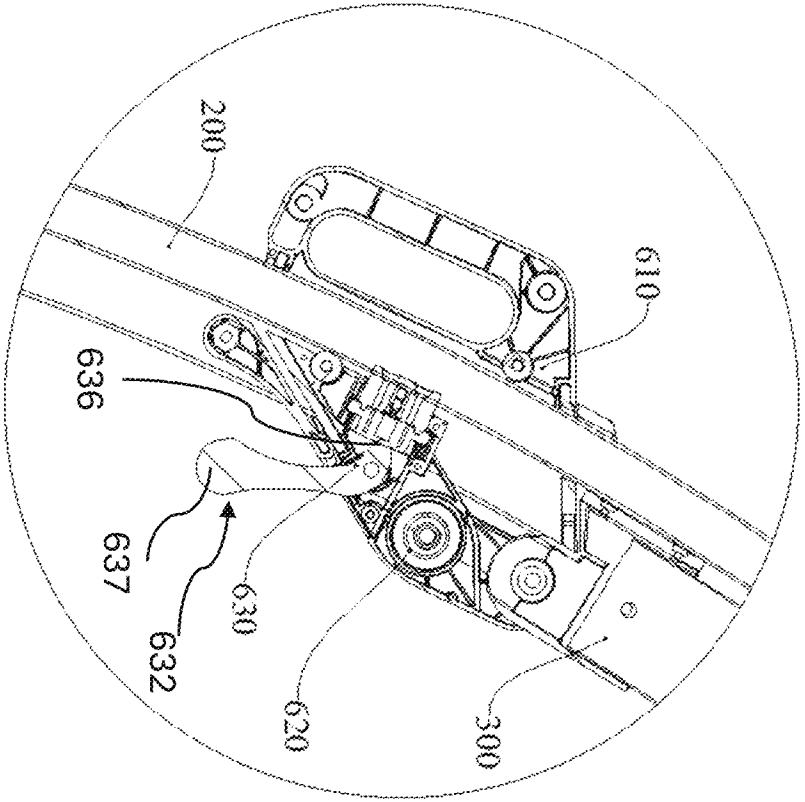
FIG. 2 is a schematic structural illustration of a vertical cross-section view of the handle assembly embodiment in the present utility invention (enlarged view of Section A in FIG. 1B).
Figure 3A:
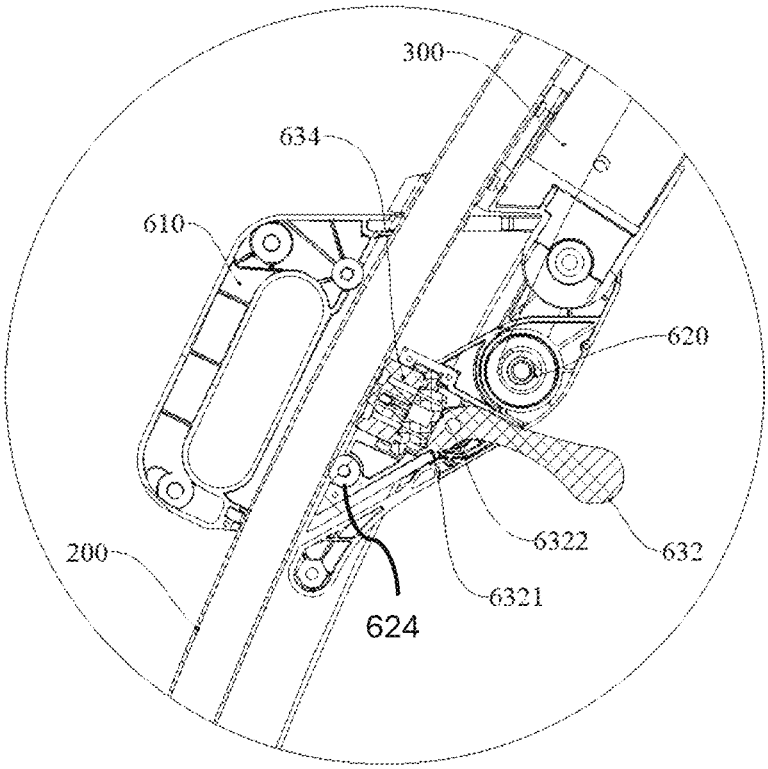
FIG. 3A is a schematic structural illustration of the vertical cross-section view of FIG. 2 when the locking mechanism embodiment is in an unlocked state, according to the present utility invention.
Figure 3B:
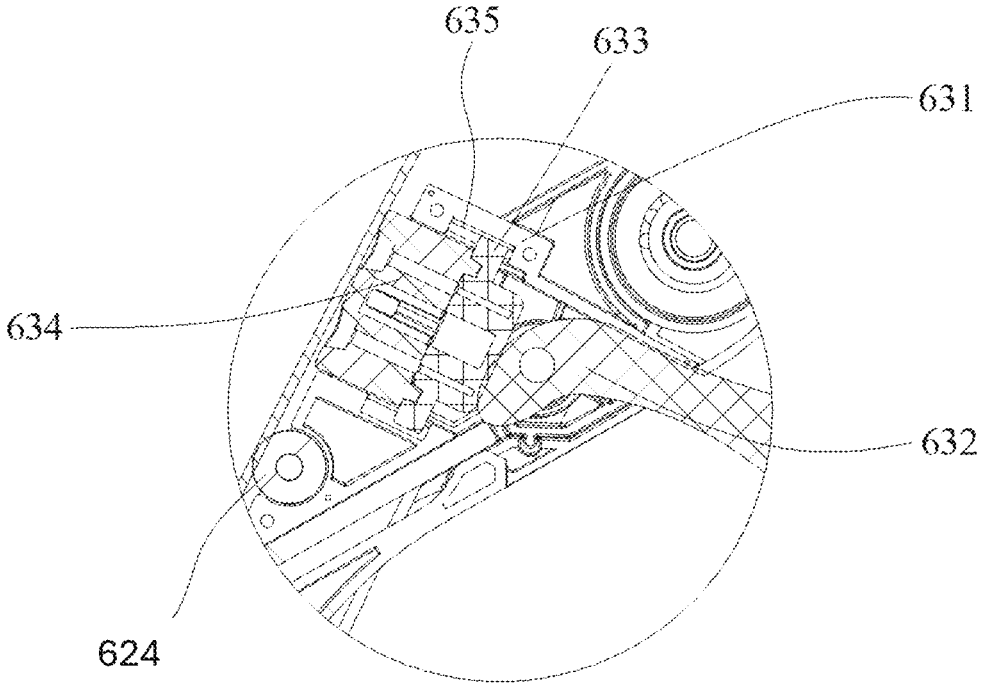
FIG. 3B is an enlarged view of part of the locking mechanism shown in FIG. 3A.
Figure 6:
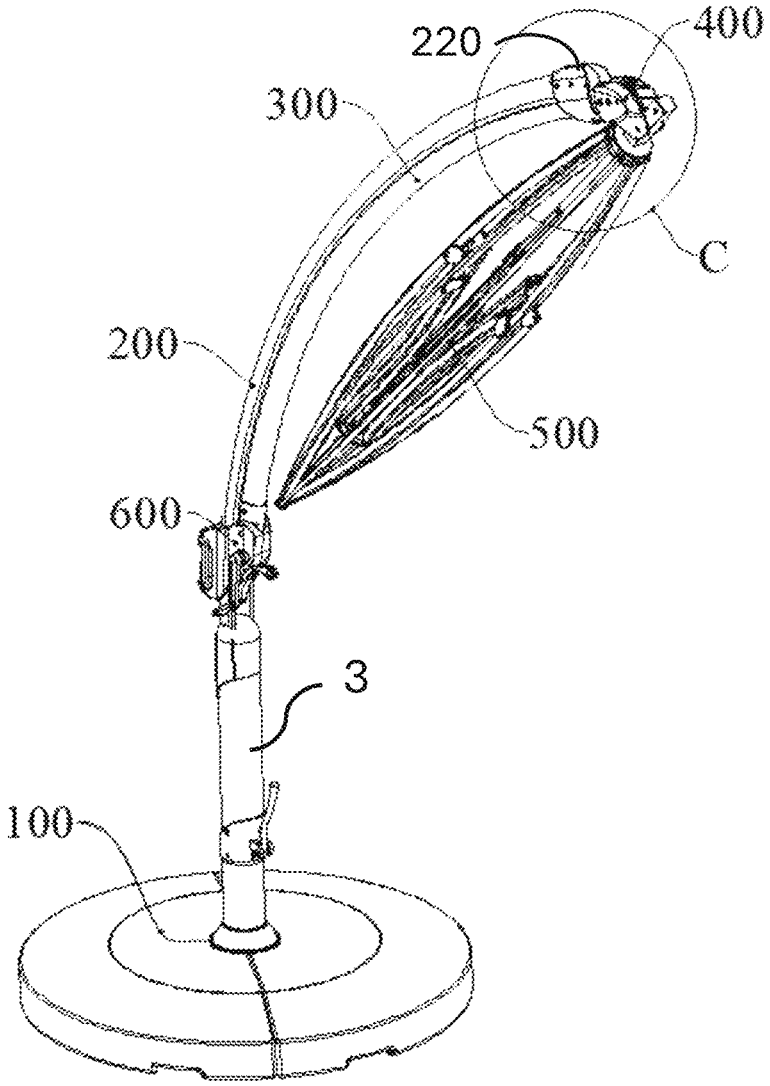
FIG. 6 is a schematic illustration of an umbrella embodiment with its main canopy frame and arched spine in a fully folded state, according to the present utility invention. The entire arc of the upper arched tube is shown to overlap with the arc of the lower arched tube as the umbrella is fully folded or collapsed together.

Referring to FIG. 1 (open state) and FIG. 6 (closed state), the present invention discloses a double-arc tube (or spine) cantilever umbrella in a sliding-sleeve configuration. The disclosed umbrella includes, in terms of major structures, an tube base support 100 for supporting the tubes and the umbrella in general, a lower arched tube 200, an upper arched tube 300, a main umbrella canopy frame 500 connected to the upper arched tube through a canopy base junction 400, and a handle assembly 600. Of these, in a preferred embodiment, the lower arched tube 200 is affixed to the tube support 100 and of a semi-elliptical or kidney shape, and a mounting channel 205 matching the upper arched tube 300 is provided in the inner surface of the lower arched tube 200. The upper arched tube 300 is slidably fitted inside the mounting channel 205 with two structures to hold it from falling out: at the proximal end of the upper arched tube 300, the handle assembly 600; and at the distal end of the lower arched tube 200, a support clamp 220 in the shape of two shell-like structures. The outside of the upper arched tubc 300 passes through the support clamp 220 and its weight is partly supported by said support clamp 220. Accordingly, the mounting channel and other structures enable the provision of semi-coverage or housing for the upper arched tube 300. The upper arched tube 300 can, under the control of the handle assembly 600, slide along the curvature/arc of the lower arched tube 200 inwards/downwards or outwards/upwards, and can be stopped and locked at any desired position along the lower arched tube. As an operator moves the handle assembly 600 towards the tube support 100, eventually the entire arc of the upper arched tube 300 will be collapsed or otherwise fitted into the mounting channel 205 in the lower arched tube 200 (FIG. 6), which minimizes transportation and storage space as the upper arched tube 300 partly nestles inside the lower arched tube 200. The umbrella's main canopy frame 500 is installed at the distal end of the upper arched tube 300 through the canopy base junction 400, and the angle of the canopy surface of the main canopy frame 500 can be adjusted through up-and-down movements of the upper arched tube 300 (details explained below).

Figure 4A:
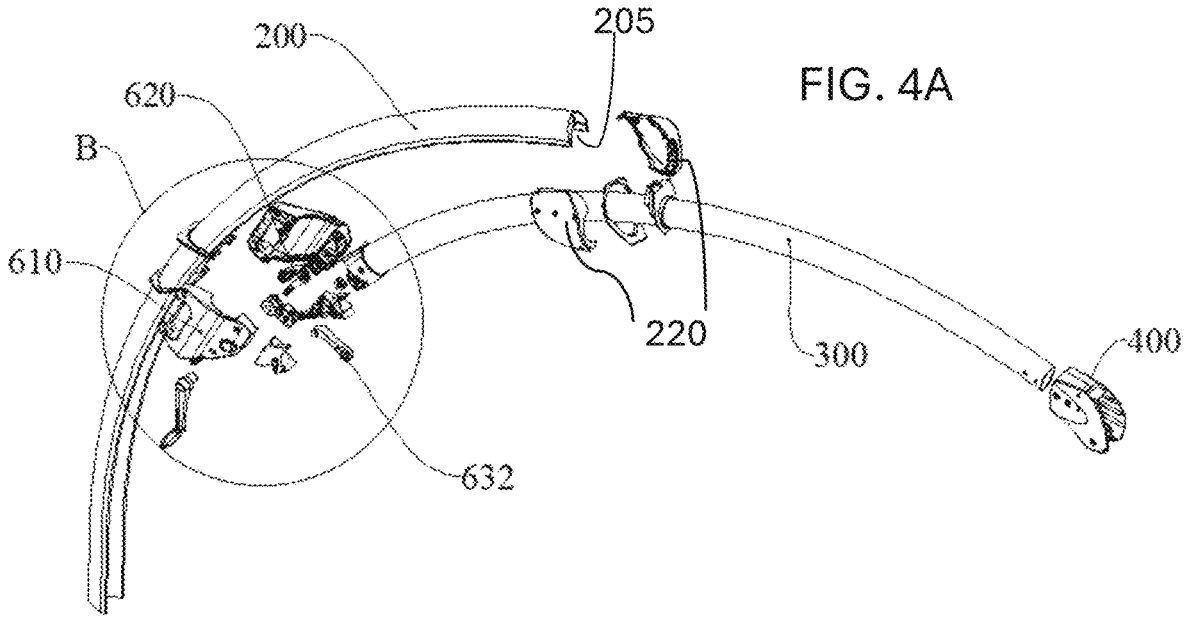
FIG. 4A is an illustrative, exploded view of parts of an embodiment in the present utility invention.
Figure 4B:
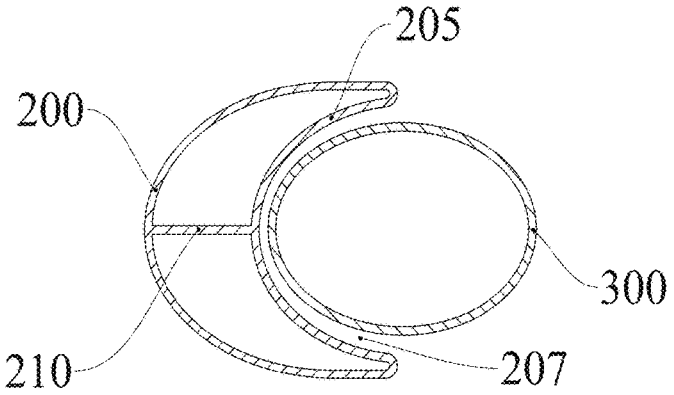
FIG. 4B is a horizontal cross-sectional view of the two arched tubes where they overlap in the embodiment shown in FIG. 4A.

Specifically, as shown in FIGS. 4A and 4B, the lower arched tube 200, with a cross-section resembling an arched bridge, crescent moon, kidney or fan shape, would cover about half of the outer surface of the upper arched tube 300 which has an oval, elliptical or circular cross-section, after fully receiving the latter in the mounting channel 205 formed by the concave side in the corresponding cross-section (FIG. 6). In other words, as the upper arched tube 300 slides downward and is withdrawn into the lower arched tube 200, the semi-coverage starts to form.

Figure 4C:
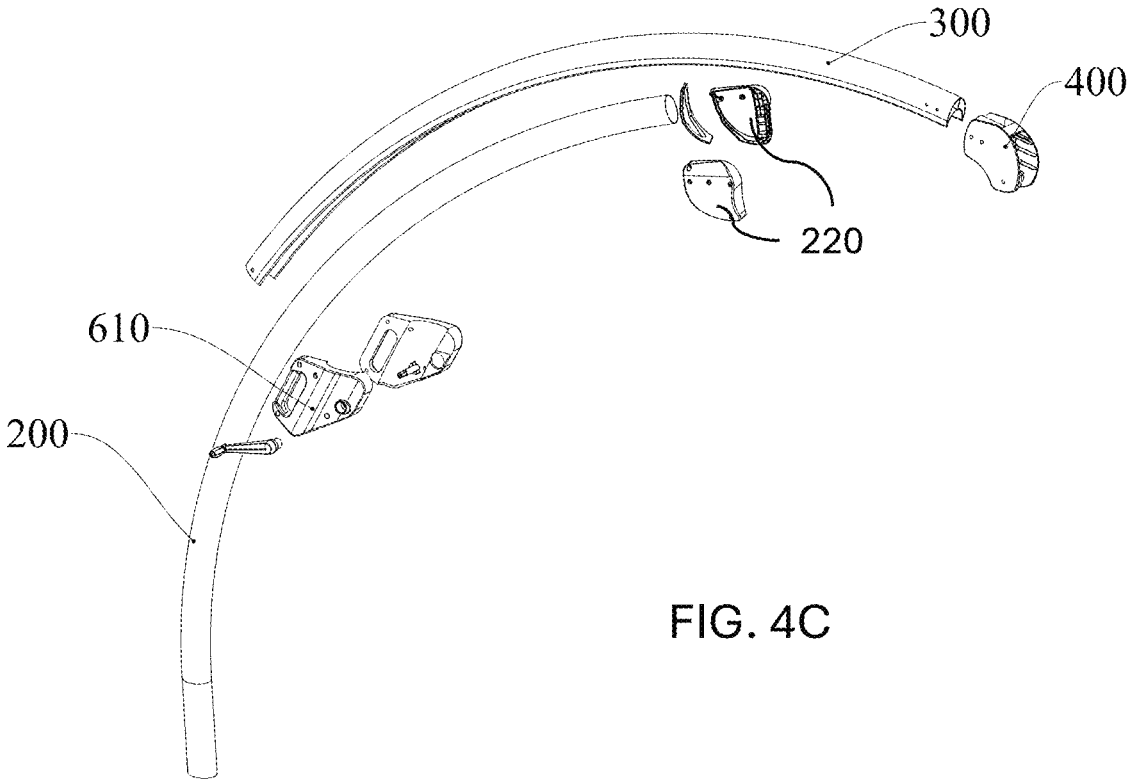
FIG. 4C is an illustrative, exploded view of parts of an alternative embodiment in the present utility invention.
Figure 4D:
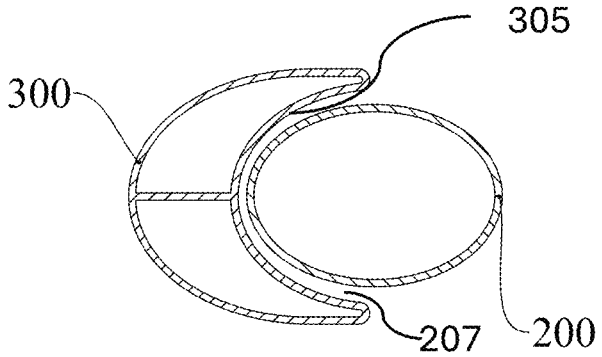
FIG. 4D is a horizontal cross-sectional view of the two arched tubes where they overlap in the embodiment shown in FIG. 4C.

In other embodiments also contemplated by the present invention, the cross-sections of the two arched tubes can be of any other suitable shapes so along as partial coverage of one is achieved by the other. For example, a first arched tube can have a cross-section that is or resembles a circle, an oval, a triangle, a rectangle, a pentagon, a hexagon, a heptagon, an octagon, and so on, while a second arched tube's cross-section wraps around the first and provides partial coverage in the shape that is or resembles a crescent moon, a fan, a staple, a two-prong clamp, a multi-prong fork, and so on. Besides the pair shown in FIGS. 4A and 4B, in another embodiment shown in FIGS. 4C and 4D, the two tubes can switch shape with other, i.e., the lower arched tube 200 may have a circular or oval cross-section while the upper arched tube 300, which now receives the lower arched tube 200 in its mounting channel 305, slides along the latter and is still connected to the umbrella canopy frame (not shown) through the canopy base junction 400. The upper arched tube 300 can have a kidney-shaped cross-section instead, thereby providing partial coverage over the lower arched tube 200. In other words, here the lower arched tube 200 partly nestles inside the mounting channel 305 of the upper arched tube 300. To stabilize the coverage and keep the upper arched tube 300 fitted over the lower arched tube 200, a support clamp 220 is similarly provided at the distal end of the lower arched tube 200 in addition to the handle assembly 600 at the proximal end of the upper arched tube 300.

And by "partial coverage," it is meant that one of the arched tubes provides coverage, shielding or housing for at least and including 20%, 30%, 40%, 50%, 60%, 70%, 80%, or 90% over the outer surface of the other arched tube, where the space or clearance 207 between the two tubes is no more than about 10, 8, 6, 5, 4, 3, 2, 1 mm. In preferred embodiments, one arched tube provides about 20-80%, 30-70%, 40-60%, or about 50% coverage over the other arched tube when the two are collapsed, fitted or regressed into one ("fully overlapped") as shown in FIG. 6, and the clearance between the two tubes is no more than about 4, 3, 2 or 1 mm. In one embodiment, the two arched tubes are close enough to each other to be touching. A major aim of this feature of the invention is to save space for shipping and storage. For manufacturing purpose and to resist deformation, one or more enforcement structures, e.g., a partition 210, can be arranged inside an arched tube.

As shown in FIGS. 1A-5, the handle assembly 600 includes a handle shell body 610, a winding wheel set 620, and a locking mechanism 630 installed in coordination with the handle shell body 610. The bottom of the upper arched tube 300 is installed on top of the handle shell body 610. The handle shell body 610, in turn, is comprised of a first shell body 611 and a second shell body 612, the two of which are coupled and sleeved/clamped over the lower arched tube 200, so that the handle shell body 610 can slide inwards or outwards along the curvature of the lower arched tube 200. The handle shell body 610 is provided with a mounting cavity for winding wheel 621 and a lock mounting cavity for a locking mechanism. The winding wheel set 620 is arranged in the mounting cavity for winding wheel 621, and is used for controlling the unfolding or folding of the umbrella's main canopy frame 500. A locking mechanism 630 is arranged in the lock mounting cavity, so that the handle shell body 610 can slide to any desired position and remain locked there, and thereby realizing full storage or extension of the upper arched tube in relation to the lower arched tube.

Whereas the specific structures are illustrated in FIGS. 2-5, the locking mechanism 630, in an illustrative embodiment, includes a mounting seat 631, a control member 632 and a locking assembly. Of these, the mounting seat 631 is affixed in a lock mounting cavity, and a sliding groove 635 matching the locking assembly is provided on the side of the mounting seat 631 closer to the lower arched tube 200. The locking assembly is slidably connected inside the sliding groove and can be driven by the control member 632 to move towards the side of the lower arched tube 200, and locking of the handle shell body 610 is achieved through static friction force between the locking assembly and the inside of the lower arched tube 200. When the control member 632 releases the pressure applied to the locking assembly, the static friction force between the locking assembly and the lower arched tube 200 is weakened, so that the handle shell body 610 can again slide or glide over the lower arched tube 200.

Of these, the locking assembly is comprised of a sliding block 633 and a pressing block 634, and the control member 632 adopts a locking trigger. The pressing block 634 is affixed onto the sliding block 633 through one or more screws. The locking trigger is rotatably connected to the mounting seat 631. When a user pulls or pushes the locking trigger downwards, the sliding block 633 will be driven towards the side closer to the lower arched tube 200, so that the pressing block 634 is pressed tightly against the lower arched tube 200, thereby enabling locking of the lower arched tube 200 through the handle shell body 610. When the user pulls or pushes the locking trigger upwards, the pressure force applied to the sliding block 633 will be released, the sliding block 633 automatically slides down under the influence of gravity; the pressing block 634 moves away from the lower arched tube 200, and the unlocking of the handle shell body 610 against the lower arched tube 200 is achieved.

In the present embodiment, the locking trigger is divided into a locking part 636 on the inside end and a holding part 637 on the outside. A user can hold the holding part 637 of the locking trigger and move upwards or downwards to drive the locking part 636 to rotate. Best viewed in FIGS. 2, 3A and 3B, the locking part 636 is of an oval/elliptical structure and consists of a protruding section 6321 on the inner terminal and an unlocking section 6322 on the outer side. The locking part is provided with two restrictive stops in the rotating process: a restrictive locking stop and a restrictive unlocking stop, respectively. When the locking part reaches the restrictive locking stop, the protruding section 6321 on the locking part abuts against the sliding block 633. The line connecting the end of the protruding section 6321 to the rotating center of the locking trigger is parallel to the sliding directions of the sliding block 633, so that the force and the reaction force between the sliding block 633 and the locking trigger balance out, and the locking trigger is prevented from rotating, thereby automatically unlocking the handle shell body 610. When the locking part is in the restrictive locking stop, the unlocking section 6322 of the locking part abuts against the sliding block 633 instead. As the unlocking section 6322's movement creates the space for the sliding block 633 to be released, the adjacent pressing block 634 separates from the lower arched tube 200, thereby unlocking the handle shell body 610 from the lower arched tube 200.

Figure 5:
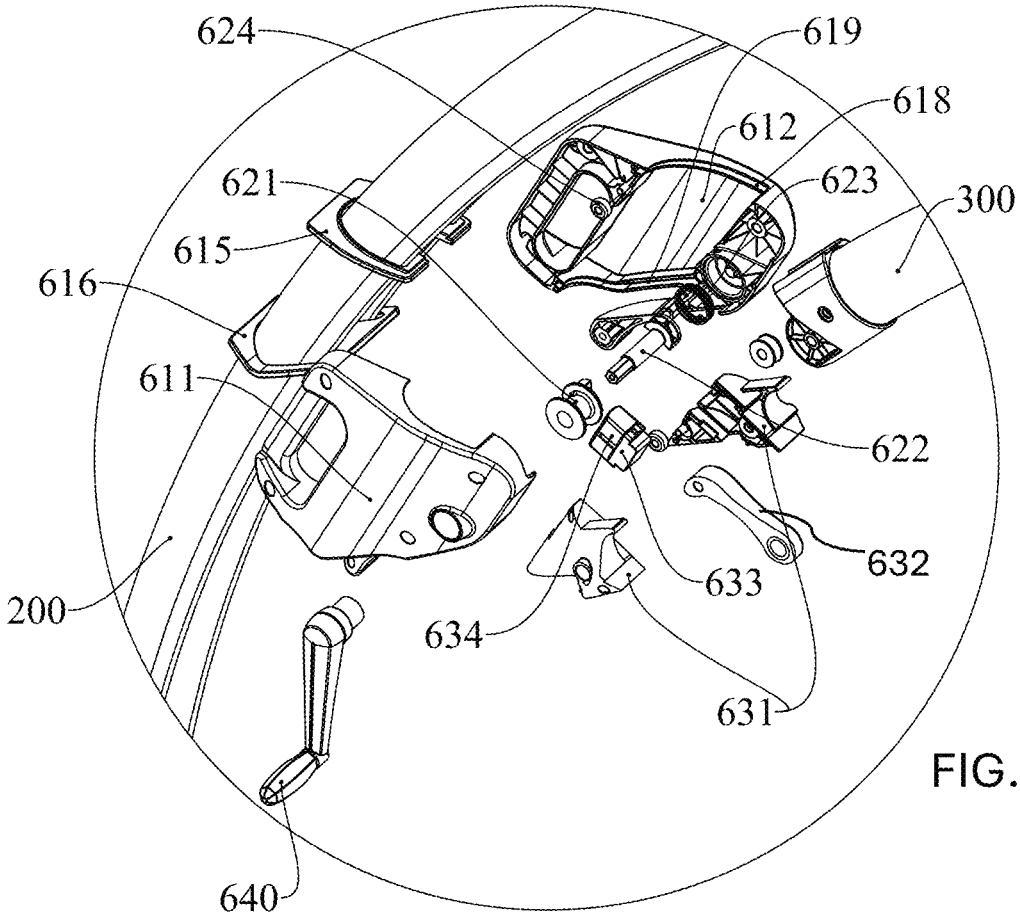
FIG. 5 is an illustrative, exploded view of parts of a winding wheel set in an embodiment of the present utility invention (enlarged view of Section B in FIG. 4A).

As shown in FIG. 5, the winding wheel set 620 includes a winding wheel 621, a crank axle 622 and a first torsion spring 623 which are sequentially connected in series in a sleeving fashion. Of these, a crank handle 640 is detachably arranged at the large outer end of the crank axle 622 and used for driving the crank axle 622 to rotate, and in turn the winding wheel 621 arranged on the crank axle 622. A wire rope is wound about the winding wheel 621. The distal end of the wire rope is connected to the umbrella's main canopy frame 500. A torsion spring capable of stopping sliding in both directions is selected as the first torsion spring 623 and used for locking after the crank axle 622 rotates by any number of turns. During use, when the winding wheel 621 is driven by the crank axle 622 to wind up the rope, the upper umbrella disk and the lower umbrella disk in the main canopy frame 500 are pulled closer to each other, and the main canopy frame 500 displays an open state. When the rope is unwound through the winding wheel 621, the upper umbrella disk and the lower umbrella disk in the main canopy frame 500 move farther away from each other due to the loss of tension, and the umbrella main canopy frame 500 displays a closed/folded state.

Figure 7A:
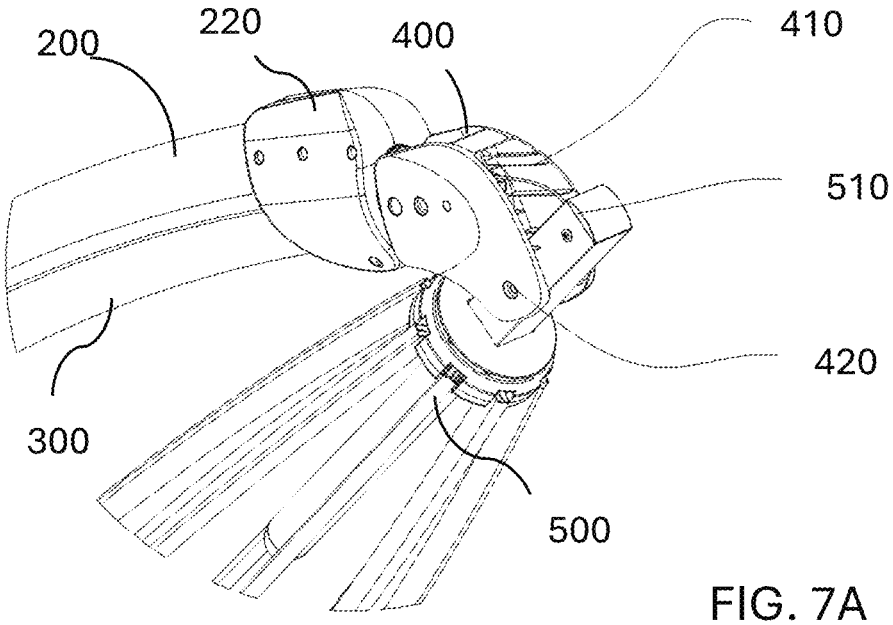
FIG. 7A is a schematic structural illustration of an umbrella's canopy base junction embodiment according to the present utility invention (enlarged view of Section C in FIG. 6) with the umbrella canopy frame in a folded state.
Figure 7B:
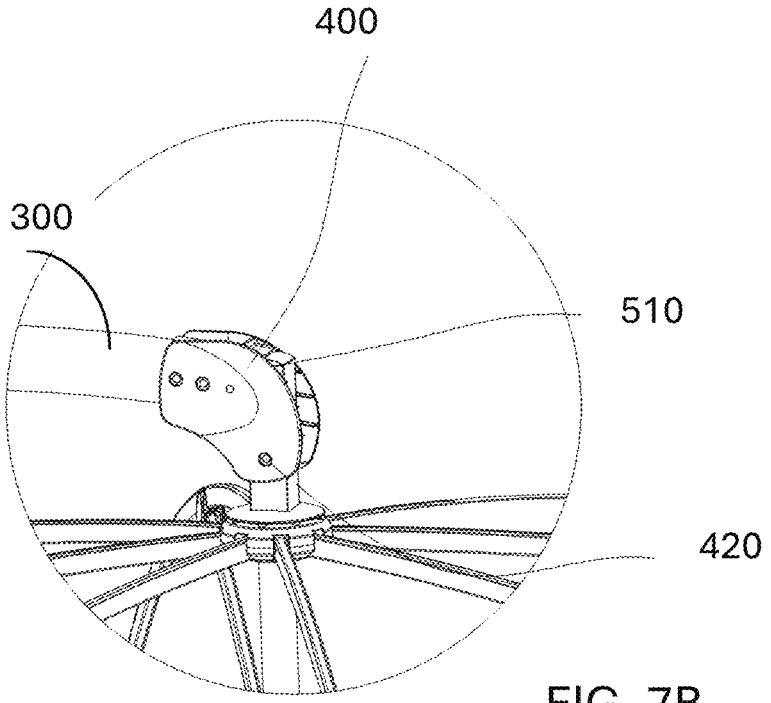
FIG. 7B illustrates the same embodiment as in FIG. 7A but with the umbrella canopy frame in an open/unfolded state.

Further, as shown in FIGS. 6, 7A and 7B, the top of the umbrella main canopy frame 500 is rotatably connected with the canopy base junction 400. The canopy base junction 400 is provided with one or more stopping edges or barriers ("edge stop") 410 that cooperate with the top tip 510 of the main canopy frame 500 by providing a U-shaped trough that limits further movement of the canopy top 510. In an initial state, the umbrella main canopy frame 500 is in a closed/folded state and can rotate about an axis 420 on the canopy base junction 400, thereby achieving further folding with respect to the upper arched tube 300. When it is time to open the main canopy frame 500, winding the rope preferably pulls the main canopy frame 500 to rotate about the same axis 420 on the umbrella canopy base junction 400. When the top 510 of the main canopy frame 500 rotates to a vertical state to the upper arched tube 300, it will meet and be stopped by the edge stop 410 on the canopy base junction 400 and henceforth leading to the unfolding of the main canopy frame 500 as shown in FIG. 7B.

Further, the umbrella main canopy frame 500 remains in an unfolded/open state under the pulling of the wire rope. Because the top tip 510 of the main canopy frame 500 is constrained by the canopy base junction 400's main body, the main canopy frame 500 stays perpendicular to the distal end of the upper arched tube 300. When the upper arched tube 300 is driven to slide outwards or inwards, the orientation of the canopy surface in the main canopy frame 500 moves in sync with the movement of the upper arched tube 300, thereby adjusting the angle of the canopy surface.

In this embodiment, an upper lining 615 and a lower lining 616 are further arranged on the lower arched tube 200 at an interval. A first clamping groove 618 and a second clamping groove 619 corresponding to the upper lining 615 and the lower lining 616, respectively, are provided in the opposite and facing sides of the first shell body 611 and the second shell body 612 (best viewed in FIG. 5). In particular, the first clamping groove 618 and the second clamping groove 619 are formed in the top and the bottom, respectively, of a clamping notch that matches the first shell 611 and the second shell 612 to the lower arched tube 200. The upper lining 615 and the lower lining 616 are embedded in the first clamping groove 618 and the second clamping groove 619, respectively, and used for compensating aberrations when the first shell 611 and the second shell 612 are sleeved over the lower arched tube 200—at the same time, these linings lead to dustproof and waterproof effects on the interiors of the first shell 611 and the second shell 612.

Moreover, pulleys 624 are arranged on the edges of the two sides of the clamping notch where the first shell body 611 and the second shell body 612 sleeve over the lower arched tube 200. Such pulleys are used for assisting the sliding or gliding of the first shell body 611 and the second shell body 612 along the length of the lower arched tube 200.

Example 2

Figure 8:
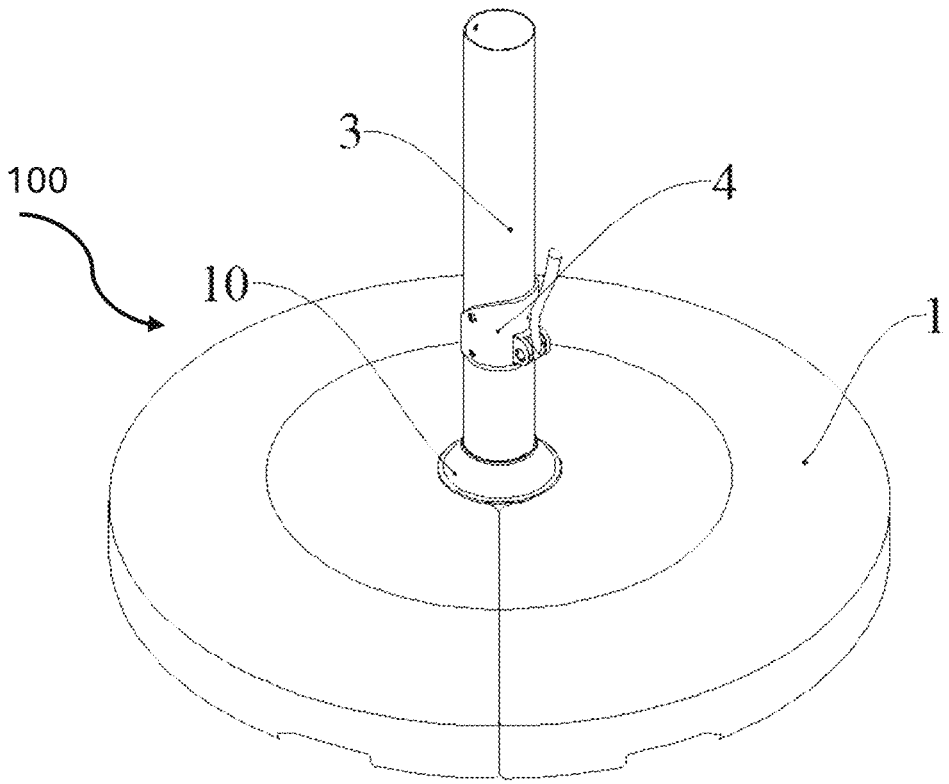
FIG. 8 is a schematic structural illustration of an overall structure of Example 2 of the present utility invention.
Figure 13:
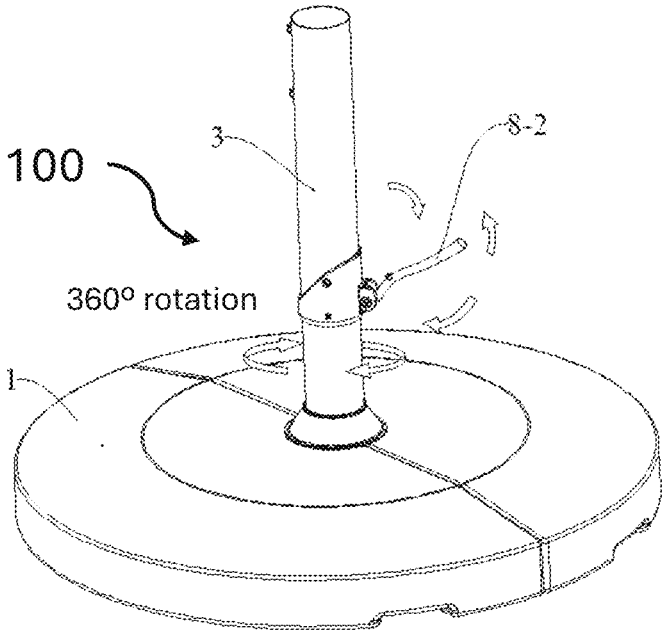
FIG. 13 is a schematic illustration of the outer vertical pipe's movements as effected by movements of the wrench in Example 2 of the present utility invention.

Based on Example 1, in reference to FIGS. 8 and 13, the invention further discloses a tube support or base 100 that can be employed to support an umbrella spine including the arced spine (due-arched tubes) and other features of the present invention. The tube support 100 can be rotated through a wrench, which would effect rotation of the spine such as the arched tubes of Example 1 installed above. The tube support 100, in one aspect, includes a mounting base 1, an inner vertical pipe 2, an outer vertical pipe 3 and a locking structure 4, where the inner vertical pipe 2 is affixed to the mounting base 1 (see, e.g., FIGS. 9 and 10). In one embodiment, the mounting base 1 is circular or oval in its shape or cross-section; the outer vertical pipe 3 is of a circular pipe structure, and is sleeved over the outer surface of the inner vertical pipe 2 to form cooperative rotation relative to the inner vertical pipe 2. The locking structure 4 is arranged between the inner vertical pipe 2 and the outer vertical pipe 3 and can control the locking and unlocking of the rotating outer vertical pipe 3, thereby achieving the canopy 500's 360-degree rotation and locking about the base support 100.

According to a principle of the present invention, the lower arched tube 200 is fixedly connected to the outer vertical pipe 3 by any suitable means known to one skilled in the art, e.g., welding, adhesive, or fastener (screws, rivets, clamps, and so on). In one embodiment, the lower arched tube 200 is sleeved over the distal portion of the inner vertical pipe 2 before connecting to the outer vertical pipe 3. As a result, rotating the outer vertical pipe 3 results in the rotation of the lower arched tube 200, and in turn, the upper arched tube 300 and the canopy connected therewith.

Figure 9:
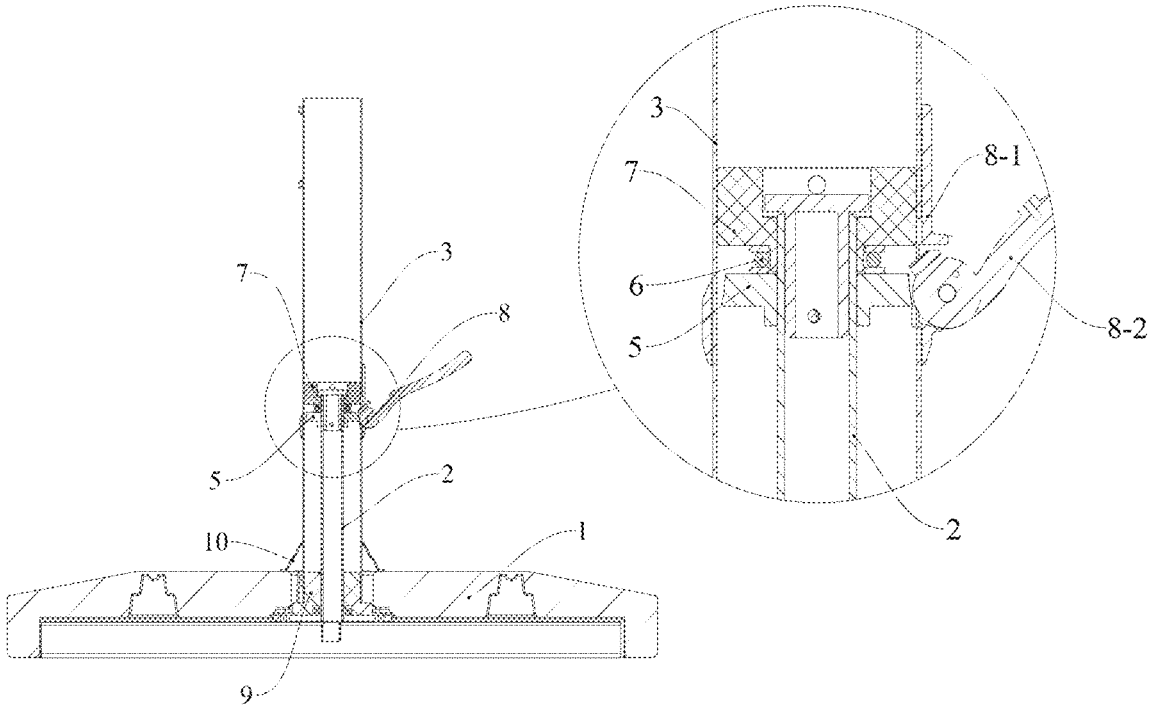
FIG. 9 is a schematic vertical cross-section view of a locking structure in Example 2 of the present utility invention with a section enlarged for a clearer view.
Figure 10:
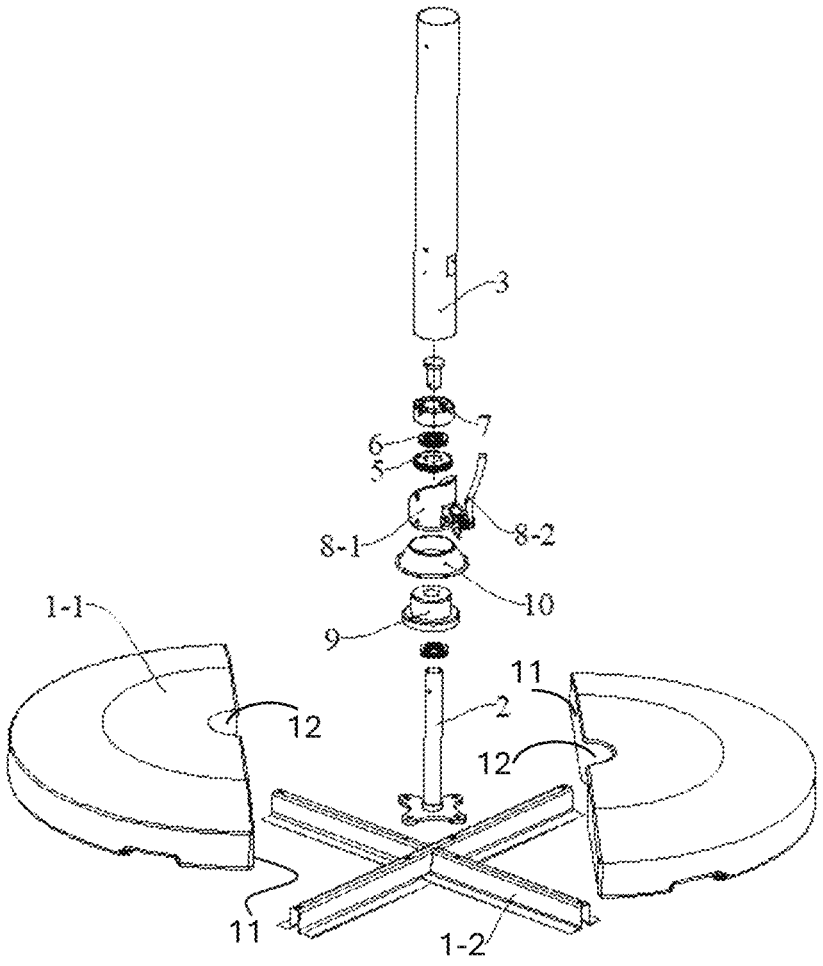
FIG. 10 is an illustrative, exploded view of parts in Example 2 of the present utility invention.

Specifically, still referring to FIGS. 9 and 10, the locking structure 4 includes a fluted disk 5, a first gasket bearing 6, a rotating sleeve piece 7 and a locking assembly 8, where the fluted disk 5 is affixed to the top of the inner vertical pipe 2. The rotating sleeve piece 7 is fixedly attached to the outer vertical pipe 3 and is connected with the fluted disk 5 through the first gasket bearing 6, so that the rotating sleeve piece 7 can rotate relative to the fluted disk 5. The locking assembly 8 is installed on the outer vertical pipe 3, and locking or unlocking of the outer vertical pipe 3 is achieved by the locking assembly 8's coupling or decoupling from the teeth/grooves in the fluted disk 5.

In this embodiment, a penetrating, first connecting aperture is provided in the upper side wall of the rotating sleeve piece 7, and a second connecting aperture corresponding to the first connecting aperture is provided in the outer vertical pipe 3. The outer vertical pipe 3 is further provided with a first pin bushing that cooperates with both the first connecting aperture and the second connecting aperture. The inner end of the pin bushing sequentially passes through the first connecting aperture and the second connecting aperture, thereby affixing the outer vertical pipe 3 to the rotating sleeve piece 7.

Further, a vertically penetrating position-restricting aperture (or "restricting aperture") is provided in the rotating sleeve piece 7. The restricting aperture is, in this embodiment, of a stepped structure. A connecting shaft for position-restriction (or "restricting shaft") is arranged in the restricting aperture. The bottom of the restricting shaft is fixedly connected to the inner vertical pipe 2 and is used for restricting the relative positions between the rotating sleeve piece 7 and the fluted disk 5. The fluted disk 5, the inner vertical pipe 2 and the restricting shaft are fixedly connected through a second pin bushing.

Specifically, a first fixation aperture is provided in the bottom of the restricting shaft. The inner vertical pipe 2 is provided with a second fixation aperture that is in communication with the first fixation aperture. The bottom of the fluted disk 5 is provided with an integrally formed connecting edge. A third fixation aperture in communication with the second fixation aperture is provided in the connecting edge. The inner end of the second pin bushing sequentially passes through the third fixation aperture, the second fixation aperture and then the first fixation aperture, thereby locking down the relative positions between the fluted disk 5, the inner vertical pipe 2 and the restricting shaft.

In combination with the above, the locking assembly 8 includes a fixed sleeve seat 8-1 and a wrench 8-2, where the fixed sleeve seat 8-1 is affixed to the outer vertical pipe 3, and a first receding groove is provided in the outer vertical face of the sleeve seat. The outer vertical pipe 3 is provided with a second receding groove in communication with both the first receding groove and the inner cavity of the outer vertical pipe 3. The wrench 8-2 is rotatably connected to the fixed sleeve seat 8-1, and the inner end of the wrench 8-2 is provided with an integrally formed locking piece 8-3. The locking piece 8-3 passes through the first receding groove and the second receding groove, and extends into the inner cavity of the outer vertical pipe 3. Locking grooves that cooperate with the grooved teeth of the fluted disk 5 are provided on the outer portion of the locking piece 8-3.

Figure 11:
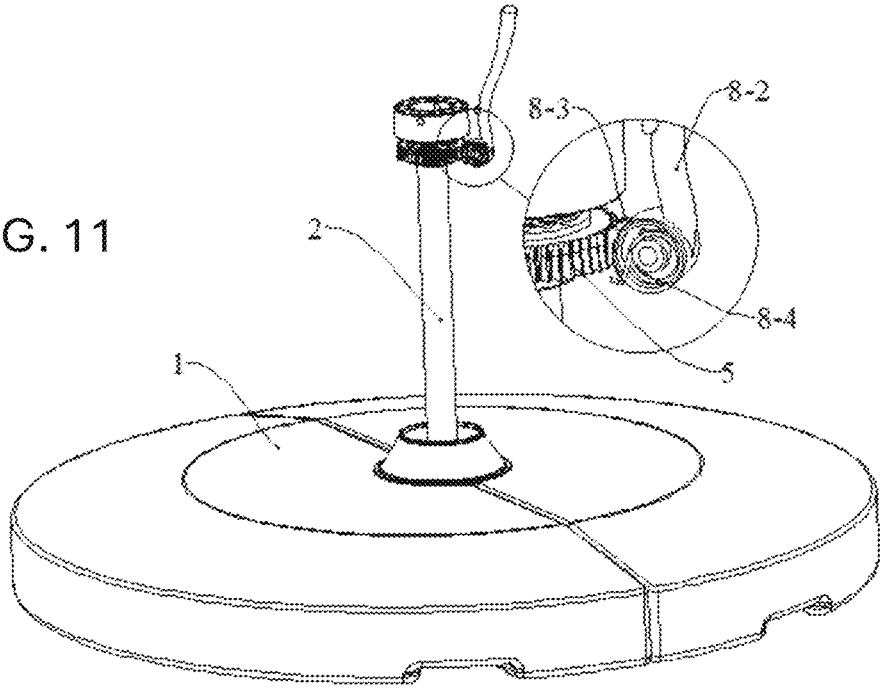
FIG. 11 is a schematic illustration of relative positions between a fluted disk and a wrench under a locked state in Example 2 of the present utility invention.
Figure 12:
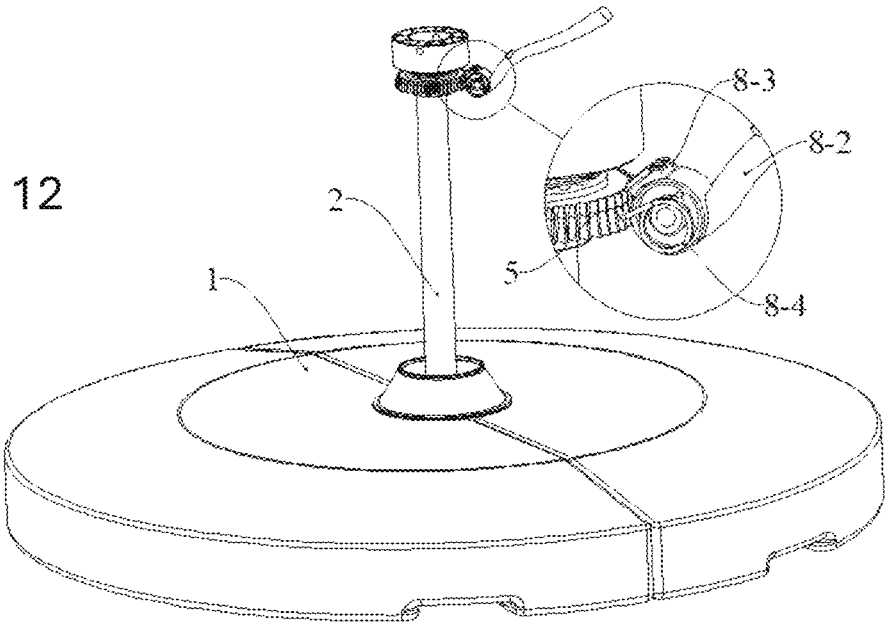
FIG. 12 is a schematic illustration of relative positions between a fluted disk and a wrench under an unlocked state in Example 2 of the present utility invention.

Based on the above description, and best viewed in FIGS. 11 and 12, in an initial state, the wrench 8-2 is turned upwards to a terminal position, one or more locking grooves on the outer portion of the locking piece 8-3 receptively mate with one or more grooved teeth in the fluted disk 5, thereby locking the relative position of the outer vertical pipe 3 versus the inner vertical pipe 2—as a result, the outer vertical pipe 3 cannot rotate or turn. When the outer vertical pipe 3 needs to be rotated or adjusted, the wrench 8-2 is turned downwards, driving the locking piece 8-3 to move simultaneously, where the locking grooves on the outer portion of the locking piece 8-3 are gradually separated from the grooved teeth in the fluted disk 5. Once the outer vertical pipe 3 is unlocked, it can be adjusted by any angle relative to the inner vertical pipe 2.

In this particular embodiment, the fixed sleeve seat 8-1 is connected to the outer vertical pipe 3 through rivets.

Further, a mounting groove is provided in the rotating end of the wrench 8-2. A second torsion spring 8-4 is embedded in the inner wall of the mounting groove. The inner end of the second torsion spring 8-4 is fixedly attached to the inner wall of the mounting groove, and the outer end of the second torsion spring 8-4 abuts against the outer vertical face of the fixing sleeve seat 8-1. When a user presses the wrench 8-2 downwards, the second torsion spring 8-4 deforms. When the user removes the pressure applied to the wrench 8-2, the second torsion spring 8-4 resets, driving the wrench 8-2 to rotate upwards, so that one or more of the locking grooves formed in the outer end of the locking piece 8-3 arranged on the wrench 8-2 are coupled with grooved teeth in the fluted disk 5, thereby locking the relative position between the outer vertical pipe 3 and the inner vertical pipe 2.

In the present embodiment and best viewed in FIGS. 9 and 10, the mounting base 1 includes a counterweight seat 1-1 and two elongated pieces 1-2 housed therein. The counterweight seat 1-1, in an embodiment, includes two counterweight blocks. The two counterweight blocks are, in this embodiment, each of a semicircular structure, and together form a circular-disk-shaped structure when closed. Housing grooves 11 are provided in the opposing sides of the two counterweight blocks. When the two balancing weights are close to each other, a housing cavity 12 is formed between the counterweight blocks. The two elongated pieces 1-2 are arranged in the housing cavity 12 in an intersecting fashion to form a cross structure. A positioning aperture matching the shape and dimension of the outer vertical pipe 3 is provided in the top portion of the housing cavity. Accordingly, the bottoms of the inner vertical pipe 2 and the outer vertical pipe 3 can extend into the housing cavity through the positioning aperture.

Further in this particular illustrative embodiment, an integrally formed mounting plate is affixed to the bottom of the inner vertical pipe 2. The mounting plate is then affixed to the two elongated pieces 1-2 using screws. A vertical-pipe-positioning sleeve 9 is fixedly inserted into the bottom of the inner cavity of the outer vertical pipe 3. A second gasket bearing is arranged between the vertical-pipe-positioning sleeve 9 and the mounting base 1, for effecting rotational connection between the outer vertical pipe 3 and the mounting base 1, so that rotation of the outer vertical pipe 3 relative to the inner vertical pipe 2 can be realized as the second gasket bearing makes it easier for the outer vertical pipe 3 to rotate relative to the mounting base 1 and the inner vertical pipe 2.

In addition, in the present embodiment, a vertical pipe cover 10 is optionally sleeved over the outside of the bottom of the outer vertical pipe 3. As the bottom of the vertical pipe cover 10 abuts against the top face of the counterweight blocks, the vertical pipe cover 10 is used for improving the stability of the outer vertical pipe 3 during rotation.

Example 3

Figure 14:
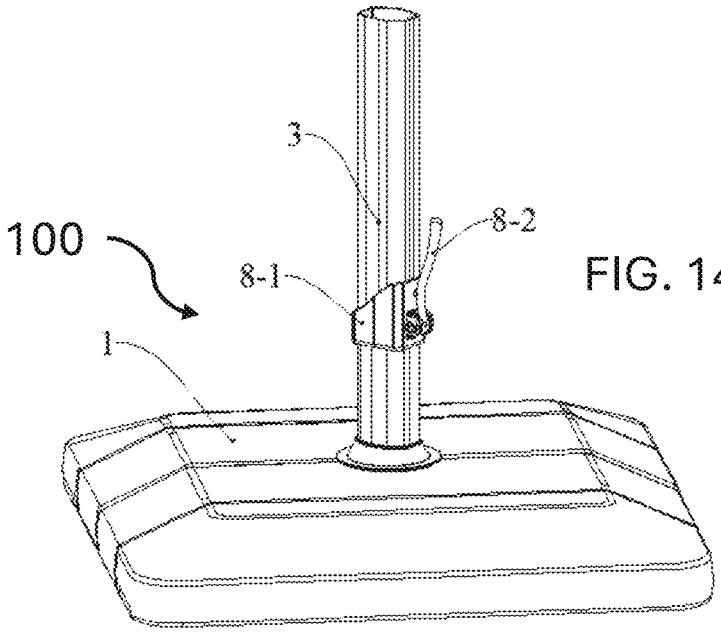
FIG. 14 is a schematic illustration of an overall structure of Example 3 of the present utility invention.
Figure 15:
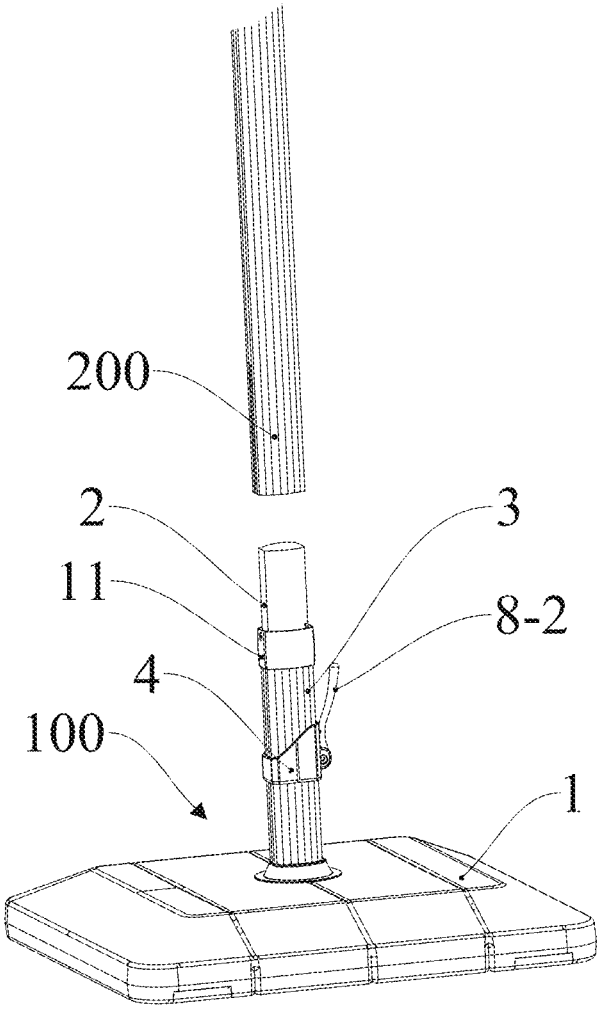
FIG. 15 is a schematic illustration of the embodiment shown in FIG. 14 showing the connection between the mounting base and the support column.

In another embodiment example illustrated in FIGS. 14 and 15, the outer vertical pipe 3 is of a non-circular pipe structure, and is sleeved over the outer surface of a similarly shaped inner vertical pipe 2 to form cooperative rotation between the two. A similar locking structure 4 is provided to control the locking and unlocking at any rotational degree between the two vertical pipes. The cross-sections of the outer vertical pipe 3 and inner vertical pipe 2 are each of a non-circular shape with two parallel opposite laterals and two arc-shaped side laterals. This four-sided shape is a mix between an oval and a rectangle. Other shapes can also be employed without departing from the principle of the present invention.

The lower arched tube 200 is fixedly connected to the outer vertical pipe 3 through any suitable means known to one skilled in the art, e.g., welding, adhesive, friction, or fastener. In one embodiment and illustrated here, the lower arched tube 200 is sleeved over the distal portion of the inner vertical pipe 2 before connecting to the outer vertical pipe 3. A reinforcement band 11 surrounding the junction between the lower arch tube 200 and the outer vertical pipe 3 is used to protect and reinforce the connection. As a result, rotating the outer vertical pipe 3 results in the rotation of the lower arched tube 200, and in turn, the upper arched tube 300 and the canopy connected therewith. In other embodiments, the outer vertical pipe 3 is manufactured as an integral part of the lower arched tube 200.

Figure 16:
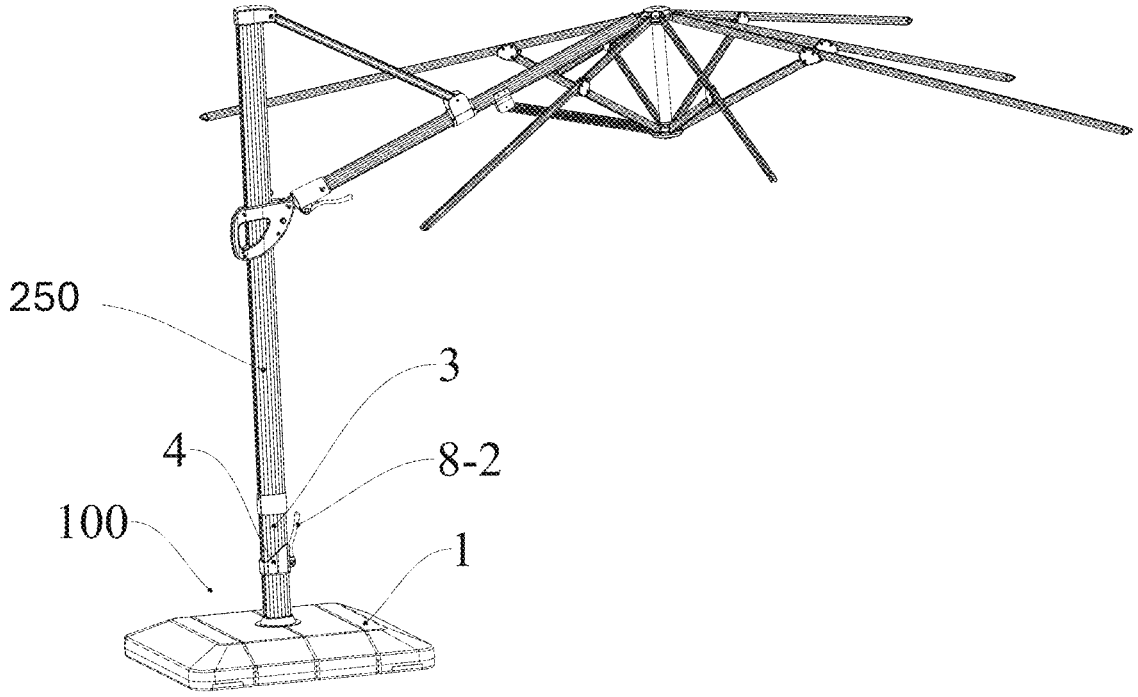
FIG. 16 is a schematic illustration of an alternative embodiment where the mounting base of the present invention is employed in a Roman umbrella.
Figure 17:
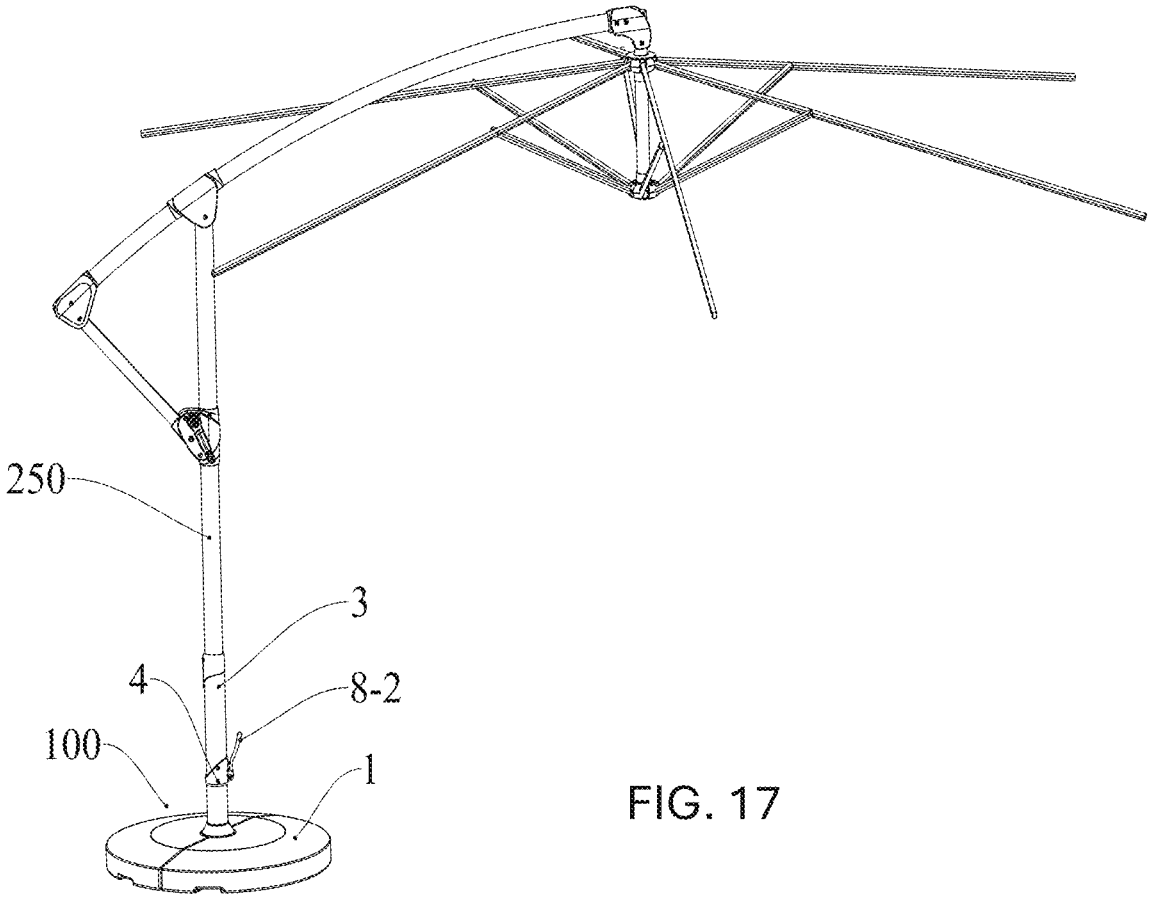
FIG. 17 is a schematic illustration of an alternative embodiment where the mounting base of the present invention is employed in a banana umbrella.

Features related to the tube support 100 disclosed herein can be used with other types of outdoor umbrellas: (a) a regular outdoor umbrella with a pole in the center of the canopy; (b) an offset or cantilever umbrella where the pole is on the side of the canopy: besides the bent arm cantilever umbrellas (e.g., the duo-arc versions disclosed in Example 1), these offset umbrellas also include Roman umbrellas (FIG. 16) and banana umbrellas (FIG. 17). In situations where the main supporting column/spine is largely straight, in order to employ the presently disclosed features related to the tube support 100, while the straight column/spine 250 can be affixed to the outer vertical pipe 3 using means well known in the art (e.g., fastener or friction), manufacturing the two as one integral piece may be the preferred way to implement the inventive feature here as the ultimate goal here is to effect single-limb (hand or foot) operation in terms of the horizontal rotation and locking of the canopy. As a result, operational convenience comes from the liberation of other limbs of the operator when one tries to unlock, rotate, and lock the canopy horizontally.

Other differences between the present embodiment and the embodiment in Example 2 include: the counterweight seat 1-1 is, in this embodiment, rectangular or square in cross-section but can be of other suitable shapes as well.

Finally, the above embodiments are only used to illustrate the technical solutions of the present invention and are not limited thereto; Although the present utility invention is described in detail with reference to the foregoing embodiments, a person of ordinary skill in the art should understand that the technical solutions described in the foregoing embodiments can still be modified, or some or all of the technical features therein can be equivalently replaced; and these modifications or replacements do not make the essence of the corresponding technical solutions separate from the scope of the technical solutions of the embodiments of the present utility invention.

The invention claimed is:

1. A cantilever umbrella, comprising an arched spine, said arched spine comprising a lower arched tube and an upper arched tube connected through a handle assembly with said upper arched tube situated at a distal end of said arched spine and connected through a canopy base junction to a main canopy frame, wherein one of said lower arched tube and upper arched tube is arranged to provide an open mounting channel that receives and only partly wraps around the other arched tube in partial but not full coverage of its outer surface, such that the upper arched tube slides along the lower arched tube when driven by said handle assembly; and wherein said handle assembly comprises a handle shell main body, a winding wheel set, and a locking mechanism assembled in cooperation with the handle shell main body; said handle shell main body is slidably connected to said lower arched tube, said locking mechanism is configured to be capable of locking positions between said handle shell main body and said lower arched tube, thereby effectively locking the connected upper arched tube at any desired position along the lower arched tube; and said winding wheel set is configured to control the open and close of the main canopy frame.

2. The cantilever umbrella of claim 1, wherein the entire arc of the upper arched tube can be collapsed into the arc of the lower arched tube, forming partial coverage by the latter.

3. The cantilever umbrella of claim 1, wherein said upper arched tube has a circular or oval cross-section, and said lower arched tube has a kidney-shaped cross-section having a concave side that forms said mounting channel to receive the upper arched tube.

4. The cantilever umbrella of claim 1, wherein: said handle shell main body comprises a first shell body and a second shell body; said first and second shell bodies are coupled and clamped over said lower arched tube; a winding wheel mounting cavity and a lock mounting cavity are provided in said handle shell main body, wherein said winding wheel set is disposed in said winding wheel mounting cavity, and a locking mechanism is disposed in said lock mounting cavity; and wherein said locking mechanism comprises a control member and a locking assembly, said locking assembly slidably connected to said handle shell main body and configured to move towards the side of said lower arched tube through a push of said control member; and when said locking assembly abuts said lower arched tube, the position between the handle shell main body and said lower arched tube is locked.

5. The cantilever umbrella of claim 4, further characterized as: said locking assembly comprises a sliding block and a pressing block wherein said pressing block is affixed to the sliding block; said control member is configured to contain a locking trigger; the locking trigger is rotatably connected to a mounting seat; when said locking trigger rotates clockwise, said sliding block is pushed towards the side of said lower arched tube; when said locking trigger rotates counterclockwise, its end moves away from said sliding block, and said sliding block naturally slides down under the influence of gravity, moving the pressing block away from said lower arched tube, thereby unlocking said lower arched tube from said handle shell body.

6. The cantilever umbrella of claim 5, further characterized as: said locking trigger comprises a locking part on the inside and a holding part on the outside for a user to hold; said locking part comprises a protruding section at one end and an unlocking section off to the side thereof; when said protruding section abuts against said sliding block, the relative positions between said handle shell main body and said lower arched tube are locked; and when said unlocking section abuts against said sliding block, the relative positions between said handle shell main body and said lower arched tube are unlocked; and wherein said lower arched tube has a cross-section in a semi-elliptical shape, while said locking part is of an oval-shaped structure.

7. The cantilever umbrella of claim 4, wherein pulleys are arranged on the edges of both sides of a clamping notch where said first and second shell bodies mate with said lower arched tube.

8. The cantilever umbrella of claim 1, further characterized as: said winding wheel set comprises a winding wheel, a crank axle and a first torsion spring, which are all sequentially arranged in series in a sleeving manner, wherein said crank axle is rotatably connected to said handle shell main body, and connected, on an outer end, to a crank handle; and a rope is wound on the winding wheel, a distal end of said rope connected to said main canopy frame.

9. The cantilever umbrella of claim 1, further characterized as: a top of the umbrella's main canopy frame is rotatably connected to said canopy base junction, wherein said canopy base junction comprises a position-stopping edge that cooperates with and limits the movement of the top of said main canopy frame.

10. The cantilever umbrella of claim 1, further comprising a tube support to which said lower arched tube is affixed, said tube support comprising: a mounting base, an inner vertical pipe, an outer vertical pipe and a locking structure, wherein said inner vertical pipe is fixedly attached to a top of said mounting base, said outer vertical pipe sleeving over an outer surface of said inner vertical pipe and forms rotational cooperation with said inner vertical pipe, and said locking structure disposed between said inner vertical pipe and said outer vertical pipe.

11. The cantilever umbrella of claim 10, further characterized as: said locking structure comprises a fluted disk comprising toothed grooves, a rotating sleeve piece and a locking assembly, wherein said fluted disk is affixed to a top of said inner vertical pipe, said rotating sleeve piece is affixed to said outer vertical pipe and rotates in cooperation with said fluted disk, and said locking assembly is disposed on said outer vertical pipe and capable of locking and unlocking said outer vertical pipe as parts of said locking assembly insert into or disengage from toothed grooves of said fluted disk, thereby effecting 360 degrees of rotation and locking at any of those degrees of said outer vertical pipe therefore said canopy relative to said inner vertical pipe.

12. The cantilever umbrella of claim 1, wherein said lower arched tube has a circular or oval cross-section, and said upper arched tube has a kidney-shaped cross-section having a concave side that forms said mounting channel to receive the lower arched tube.

13. A cantilever umbrella, comprising a lower arched tube, an upper arched tube, a main canopy frame and a handle assembly, wherein said upper arched tube is slidably connected with said lower arched tube through said handle assembly, and said main canopy frame is installed at a distal end of said upper arched tube through a canopy base junction, wherein one of said lower arched tube and upper arched tube is arranged to provide an open mounting channel that receives and only partly houses wraps around the outer surface of the other arched tube, forming partial but not full coverage by the former over the latter tube when the two are collapsed together.

14. The cantilever umbrella of claim 13 wherein the entire arc of said upper arched tube overlaps with the arc of said lower arched tube when said umbrella is fully folded together, forming partial coverage of said upper arched tube by said lower arched tube.

15. The cantilever umbrella of claim 13, wherein said upper arched tube has a circular or oval cross-section and said lower arched tube has a kidney-shaped cross-section having a concave side that forms said mounting channel to receive said upper arched tube.

16. The cantilever umbrella of claim 13, wherein said upper arched tube has a kidney-shaped cross-section having a concave side and said lower arched tube has a circular or oval cross-section where the concave side in said upper arched tube forms said mounting channel to receive said lower arched tube.

17. The cantilever umbrella of claim 13, further comprising a support clamp that connects both arched tubes.

18. The cantilever umbrella of claim 13, wherein one of the arched tubes provides coverage for about 20%-80% over the outside of the other arched tube, and any clearance between the two tubes is no more than about 4 mm.

19. An outdoor umbrella, comprising a spine connected at its distal end to a canopy frame and at its proximal end to a tube support, said tube support comprising a mounting base, an inner vertical pipe, an outer vertical pipe and a locking structure, wherein said inner vertical pipe is fixedly attached to a top of said mounting base, said outer vertical pipe is fixedly attached to said spine and sleeving over an outer surface of said inner vertical pipe, and said locking structure disposed between said inner vertical pipe and said outer vertical pipe, said spine comprising a straight column affixed at its proximal end to said outer vertical pipe and said outdoor umbrella is a Roman umbrella;

wherein said locking structure comprises a fluted disk comprising toothed grooves, a rotating sleeve piece and a locking assembly, said fluted disk affixed to a top of said inner vertical pipe, said rotating sleeve piece affixed to said outer vertical pipe and rotating in cooperation with said fluted disk, and said locking assembly disposed on said outer vertical pipe and capable of locking and unlocking said outer vertical pipe as parts of said locking assembly insert into or disengage from toothed grooves of said fluted disk, thereby effecting 360 degrees of rotation and locking at any of those degrees of said outer vertical pipe therefore said spine and said canopy relative to said inner vertical pipe; and wherein said mounting base comprises a counterweight seat and two elongated pieces installed therein, said counterweight seat comprises at least two counterweight blocks configured to have, in opposing side faces, accommodating housing grooves such that when said two counterweight blocks are closed together, a housing cavity is formed between said two counterweight blocks, wherein said two elongated pieces are arranged in the housing cavity in an intersecting fashion.

20. The outdoor umbrella of claim 19, wherein said spine comprises a lower arched tube and an upper arched tube connected through a handle assembly.

21. An outdoor umbrella, comprising a spine connected at its distal end to a canopy frame and at its proximal end to a tube support, said tube support comprising a mounting base, an inner vertical pipe, an outer vertical pipe and a locking structure, wherein said inner vertical pipe is fixedly attached to a top of said mounting base, said outer vertical pipe is fixedly attached to said spine and sleeving over an outer surface of said inner vertical pipe, and said locking structure disposed between said inner vertical pipe and said outer vertical pipe, said spine comprising a straight column affixed at its proximal end to said outer vertical pipe and said outdoor umbrella is a Roman umbrella;

wherein said locking structure comprises a fluted disk comprising toothed grooves, a rotating sleeve piece and a locking assembly, said fluted disk affixed to a top of said inner vertical pipe, said rotating sleeve piece affixed to said outer vertical pipe and rotating in cooperation with said fluted disk, and said locking assembly disposed on said outer vertical pipe and capable of locking and unlocking said outer vertical pipe as parts of said locking assembly insert into or disengage from toothed grooves of said fluted disk, thereby effecting 360 degrees of rotation and locking at any of those degrees of said outer vertical pipe therefore said spine and said canopy relative to said inner vertical pipe;

further characterized as: said locking assembly comprises a fixed sleeve seat and a wrench, wherein: said fixed sleeve seat is affixed to said outer vertical pipe, a first receding groove and a second receding groove which are in communication with each other are provided in said fixed sleeve seat and said outer vertical pipe, respectively; said wrench is rotatably connected to said fixed sleeve seat, and a locking piece is arranged at an inner end of said wrench, said locking piece passing through said first receding groove and said second receding groove, and extending into an inner cavity of said outer vertical pipe; and a locking groove that mates with the grooved teeth of said fluted disk is provided in an outer end of said locking piece; and wherein said wrench is configured with, in its rotating end, a mounting groove, a second torsion spring is embedded in an inner wall of said mounting groove with an inner end of the second torsion spring affixed to said inner wall of said mounting groove, and an outer end of said second torsion spring abutting against an outer vertical face of said fixed sleeve seat.

* * * * *